US011493255B2

(12) United States Patent
Jensen

(10) Patent No.: US 11,493,255 B2
(45) Date of Patent: Nov. 8, 2022

(54) ICE CUBE PRODUCING UNIT

(71) Applicant: Icebreaker Nordic ApS, Aalborg (DK)

(72) Inventor: Kim Jensen, Aalborg (DK)

(73) Assignee: Icebreaker Nordic ApS, Aalborg (DK)

( * ) Notice: Subject to any disclaimer, the term of this patent is extended or adjusted under 35 U.S.C. 154(b) by 0 days.

(21) Appl. No.: 16/920,015

(22) Filed: Jul. 2, 2020

(65) Prior Publication Data

US 2021/0055028 A1 Feb. 25, 2021

Related U.S. Application Data

(63) Continuation of application No. 15/517,082, filed as application No. PCT/EP2015/073074 on Oct. 6, 2015, now Pat. No. 10,753,666.

(30) Foreign Application Priority Data

Oct. 6, 2014 (DK) ..... PA201470615
Oct. 6, 2014 (DK) ..... PA201470616
(Continued)

(51) Int. Cl.
*F25C 5/20* (2018.01)
*F25C 1/22* (2018.01)
(Continued)

(52) U.S. Cl.
CPC ..... *F25C 5/20* (2018.01); *F25C 1/22* (2013.01); *F25C 1/24* (2013.01); *F25C 5/04* (2013.01)

(58) Field of Classification Search
CPC .... F25C 1/22; F25C 1/24; F25C 1/243; F25C 5/04; F25C 5/20; F25C 5/185; F25C 2500/06
See application file for complete search history.

(56) References Cited

U.S. PATENT DOCUMENTS 1,931,053 A 10/1933 Berkeley
1,971,879 A 8/1934 Szaflr
(Continued)

FOREIGN PATENT DOCUMENTS

CH 579894 A5 9/1976
DE 8608582 6/1986
(Continued)

OTHER PUBLICATIONS

European Office Action in corresponding European Application No. 15794476.0, dated Jun. 27, 2019, 7 pages.
(Continued)

*Primary Examiner* — Joseph F Trpisovsky
(74) *Attorney, Agent, or Firm* — Bookoff McAndrews, PLLC

(57) ABSTRACT

An ice cube producing unit comprising an ice cube tray having at least two ice cube compartments, a lid which is suitable for being mounted on the tray to seal water or other liquid inside said at least two ice cube compartments. Said ice cube producing unit further comprises a displacing arrangement connecting the tray and the lid and having two positions: a first position where the lid is held in a position where it abuts the ice cube tray to seal the contents of the at least two ice cube compartment inside the compartment and a second position where the lid is held in a position where it is separated from the tray so that ice cubes formed in the tray can leave the tray.

11 Claims, 19 Drawing Sheets

(30) Foreign Application Priority Data

Oct. 6, 2014 (DK) ..... PA201470617
Oct. 6, 2014 (DK) ..... PA201470618
Oct. 6, 2014 (DK) ..... PA201470619

(51) Int. Cl.
*F25C 1/24* (2018.01)
*F25C 5/04* (2006.01)

(56) References Cited

U.S. PATENT DOCUMENTS 1,976,147 A 10/1934 Smith et al.
2,083,081 A * 6/1937 Moll ..... A23G 9/083 249/120
2,269,642 A * 1/1942 Zerk ..... F25C 1/24 62/301
2,341,700 A * 2/1944 Diack ..... F25C 1/24 62/135
2,587,852 A 3/1952 Jahn et al.
2,596,021 A 5/1952 Gaugler et al.
2,613,512 A 10/1952 Gaugler
3,135,101 A 6/1964 Nigro
3,374,982 A 3/1968 Sallade
3,414,229 A * 12/1968 Norberg ..... F25C 1/24 249/121
3,565,389 A 2/1971 Price
3,620,497 A 11/1971 Schaff
3,776,504 A * 12/1973 Wiley ..... F25C 1/243 249/121
3,987,824 A 10/1976 Zehnder
4,432,529 A 2/1984 McMillan
4,496,087 A 1/1985 Marks
4,635,817 A 1/1987 Kostov
4,804,083 A 2/1989 Weeks
4,883,251 A 11/1989 Manas
4,967,995 A 11/1990 Burgess
4,997,109 A 3/1991 Carper
5,044,600 A 9/1991 Shannon
5,112,477 A 5/1992 Hamlin
5,188,744 A 2/1993 Silverman
5,196,127 A 3/1993 Solell
5,261,468 A 11/1993 Scheel
5,397,097 A 3/1995 Dale
5,405,052 A 4/1995 Sawyer
5,683,011 A 11/1997 Milliani
6,196,518 B1 * 3/2001 Garrido-Lecca ..... B65D 43/12 221/1
6,607,096 B2 8/2003 Glass et al.
7,172,087 B1 2/2007 Axe et al.
D649,984 S 12/2011 Nevarez et al.
D669,102 S 10/2012 Seo et al.
8,714,414 B2 5/2014 Koons
2005/0151049 A1 7/2005 Lion et al.
2006/0266915 A1 * 11/2006 Parker ..... F25C 1/24 249/66.1
2007/0164192 A1 7/2007 Holden et al.
2008/0256972 A1 10/2008 Knoll et al.
2008/0256973 A1 10/2008 Miller
2009/0178430 A1 7/2009 Jendrusch et al.
2011/0278430 A1 11/2011 Barno
2013/0214010 A1 8/2013 McCoy
2014/0167321 A1 6/2014 Culley et al.
2017/0363338 A1 12/2017 Jensen

FOREIGN PATENT DOCUMENTS

DE 10135206 2/2002
DE 202006006940 U1 7/2006
EP 0279408 8/1988
EP 0362112 4/1990
EP 1074801 A2 2/2001
EP 1307694 11/2005
EP 2530413 12/2012
FR 2649190 1/1991
FR 2852088 9/2004
GB 1441520 7/1976
GB 1588108 4/1981
GB 2405689 3/2005
JP 2001/021244 A 3/2005
WO WO 2005/026631 A1 3/2005
WO WO 2005/054761 6/2005
WO WO 2014/079705 A1 5/2014
WO WO 2014/102042 A1 7/2014
WO WO 2016/055495 4/2016

OTHER PUBLICATIONS

International Search Report; International Application No. PCT/EP2015/073074, 5 pages.

* cited by examiner

ICE CUBE PRODUCING UNIT

CROSS-REFERENCES TO RELATED APPLICATIONS

The present application is a continuation application under 37 C.F.R. § 1.53(b) of pending prior U.S. application Ser. No. 15/517,082, filed Apr. 5, 2017, which is the National Phase application of PCT International Application No. PCT/EP2015/073074, filed Oct. 6, 2015, which claims priority to Danish Patent Application Numbers PA201470615, PA201470616, PA201470617, PA201470618, and PA201470619, all filed on Oct. 6, 2014, all of which are incorporated herein by reference in their entireties.

The current specification discloses at least five separate inventions which are described separately, but which are related in that they all concern ice cube producing units.

First Invention:

The first invention relates to an ice cube producing unit comprising an ice cube tray having at least one ice cube compartment and a lid which is suitable for being mounted on the tray to seal water or other liquid inside said at least one ice cube compartment.

By ice cube producing unit is meant a unit into which water or other liquid can be filled after which it is placed in a freezer and the water or other liquid freezes. Inside the unit, at least one ice cube compartment is arranged in which the ice freezes into an ice cube. By ice cube is meant any 3D geometric shape formed of ice. In other words, ice cubes do not have to be right angled cubes, but could be hearts, stars, spheres, etc. . . .

In a preferred embodiment of the first invention, the ice cube producing unit according to the first invention is a handheld unit. In the context of the first invention, a "handheld" unit should be understood as a unit which is portable and which can be operated by hand. More specifically, a handheld ice cube dispensing unit according to the first invention should be able to be placed in a typical household freezer. It should furthermore be possible to remove the unit from the freezer so that it can be manually operated by a user, after which it can be placed back into the freezer.

DESCRIPTION OF RELATED ART

Ice cube trays with lids are well known in the art. For example: U.S. Pat. Nos. 5,188,744A, 2,613,512A, 5,196,127A and 4,967,995A. However prior art systems are either complex to use, have lids which need to be handled separately from the tray and/or do not seal the water inside the unit.

Furthermore, most of the ice cube trays with lids which are available in the art, are designed to enable stacking of ice cube trays on top of each other. They are not designed to seal water/liquid inside the unit.

Summary of the First Invention

It is therefore a first aspect of the first invention to provide an ice cube producing unit which is better than the prior art solutions.

This aspect is provided by the invention according to the characterizing portion of claim 1a. Additional advantageous features are described in the dependent claims.

In the claims, it is stated that the lid is "held in a position". According to the current specification this should be understood such that the unit itself holds the lid in the specified position. It is not necessary for a user to manually hold the lid in the specified position.

It should be noted that in the claims the phrase "individually sealed" is used to describe how the ice cube compartments are sealed. According to this specification this should be understood as meaning that one ice cube compartment should be individually sealed with respect to an adjacent ice cube compartment. The lid should therefore seal up against a divider between adjacent ice cube compartments. It should however, be noted that air/water channels located in the divider to allow water flow between adjacent ice cube compartments should be allowed. The limitation should be in that when the ice cube tray is sealed by the lid, the ice cube tray can be arranged in any position in a freezer without enough ice forming in the area between adjacent ice cubes which would make it difficult to break adjacent ice cubes away from each other in the unit. While the person skilled in the art should understand this definition, some more precise definitions are provided here which might be used if necessary. One definition is that the cross sectional area of the air/water channels in the side wall should be less than 20% of the total surface area of the side wall of the ice cube compartment in which the air/water channels are located. Another definition is that the cross sectional area of the air/water channels in the side wall should be less than 15% of the total surface area of the side wall of the ice cube compartment in which the air/water channels are located. Additional definitions with less than 10% and less 5% could also be used.

It should also be noted that the claims also use the term "housing". The term housing should be understood as an element which joins the lid, the tray and the displacing arrangement. The housing in one embodiment is enclosed so that the tray, the lid and the displacing mechanism are all arranged within the housing. However, in another embodiment, the housing is open and only provides a way of connecting the different elements. Furthermore, in one embodiment, the housing is directly fastened to the displacing arrangement, while the tray and the lid are directly fastened to the displacing arrangement with no direct connection to the housing. However within the scope of the current specification, the housing in this situation still joins the lid, the tray and the displacing arrangement.

It should be emphasized that the term "comprises/comprising/comprised of" when used in this specification is taken to specify the presence of stated features, integers, steps or components but does not preclude the presence or addition of one or more other features, integers, steps, components or groups thereof.

Second Invention

The second invention relates to a handheld ice cube dispensing unit. In particular, the second invention relates to a handheld ice cube dispensing unit of the kind which is arranged to dispense a limited number of ice cubes at a time from a container of ice cubes. In a preferred embodiment, the unit is arranged to dispense a single ice cube at a time.

In the context of the second invention, a "handheld" unit should be understood as a unit which is portable and which can be operated by hand. More specifically, a handheld ice cube dispensing unit according to the second invention should be able to be placed in a typical household freezer. It should furthermore be possible to remove the unit from the freezer so that it can be manually operated by a user, after which it can be placed back into the freezer.

DESCRIPTION OF RELATED ART

Prior art examples of ice cube dispensers are typically large mechanical units which are designed to be incorporated into refrigerators/drink machines/etc. . . . . For example, see U.S. Pat. No. 6,607,096 and USD649984. In general, "handheld" ice cube dispensers are not known in the prior art.

Ice cube trays are known in the art which can dispense ice cubes, but most available ice cube trays are not arranged to dispense a certain limited number of ice cubes at a time. Those that can dispense a limited number of ice cubes at a time have a complicated mechanism which is difficult to operate. Some examples are provided in FR2852088, U.S. Pat. Nos. 5,261,468, 5,188,744, 5,044,600, 4,967,995, EP0362112, EP0279408 and U.S. Pat. No. 3,565,389.

Many forms of dispensers are known in the patent literature. However, these dispensers are usually associated with small items such as pills, candy, and the like. Ice cubes are very different from typical small items since ice cubes are generally rather large and more difficult to handle than dry solid element like candy and pills.

Summary of the Second Invention

It is therefore a first aspect of the second invention to provide a hand held ice cube dispenser which is able to dispense a limited number of ice cubes at a time in a simple and effective manner.

This aspect is provided by a unit according to claim 1b. Additional advantageous features and embodiments are described in the dependent claims.

It should be emphasized that the term "comprises/comprising/comprised of" when used in this specification is taken to specify the presence of stated features, integers, steps or components but does not preclude the presence or addition of one or more other features, integers, steps, components or groups thereof. For example, in the claims for the second invention it is stated that the mechanism comprises two positions. However, it should be clear to the person skilled in the art that the mechanism should not be limited to only two positions, but that it should be limited to having at least two positions.

Third Invention

The third invention relates to a sealed ice cube tray unit comprising an ice cube tray having at least two ice cube compartments and a removable lid which is arranged on said ice cube tray to individually seal the contents of the at least two ice cube compartments.

According to the current specification, a sealed ice cube tray unit should be understood as an ice cube tray and a removable lid which together provide a sealed compartment for forming at least one ice cube.

According to the current specification, a filling opening with a plug should be understood as an opening which in a first mode is open to allow water or other liquid to be introduced into the sealed compartment and which in a second mode is sealed via the plug to prevent water or other content in the sealed compartment from leaving the sealed compartment.

Furthermore, according to the current specification, the phrase "individually sealed" should be understood as meaning that one ice cube compartment should be individually sealed with respect to an adjacent ice cube compartment. The lid should therefore seal up against a divider between adjacent ice cube compartments. It should however, be noted that air/water channels located in the divider to allow water flow between adjacent ice cube compartments should be allowed. The limitation should be in that when the ice cube tray is sealed by the lid, the ice cube tray can be arranged in any position in a freezer without enough ice forming in the area between adjacent ice cubes which would make it difficult to break adjacent ice cubes away from each other in the unit. While the person skilled in the art should understand this definition, some more precise definitions are provided here which might be used if necessary. One definition is that the total cross sectional area of the air and/or water channels in the side wall should be less than 20% of the total surface area of the side wall of the ice cube compartment in which the air and/or water channels are located. Another definition is that the total cross sectional area of the air and/or water channels in the side wall should be less than 15% of the total surface area of the side wall of the ice cube compartment in which the air and/or water channels are located. Additional definitions with less than 10% and less 5% could also be used.

DESCRIPTION OF RELATED ART

In general, sealed ice cube trays with filling openings are not well known in the prior art. Sealed Ice cube trays with filling openings and plugs are known, however these are typically provided with large volumes of empty space inside the sealed tray. See for example DE8608582U1, EP2530413A2 and GB1588108A. Due to the large volumes of empty space, when the ice cube tray unit is arranged in the freezer, it is necessary to arrange the tray level, otherwise, ice will form in the empty space instead of in the ice cube compartments.

There are examples of sealed ice cube trays where the contents of the individual ice cube compartments are individually sealed. See for example, FR264919063, U.S. Pat. Nos. 3,135,101A and 4,432,529A. However, in the known embodiments, the filling openings are provided in the lid of the ice cube tray. As such, when the water is filled into the tray, it is necessary to hold the tray level, otherwise the tray will not fill up properly. There will be too much water in one side and too little in the other side.

Summary of the Third Invention

It is therefore a first aspect of the third invention to provide a sealed ice cube tray unit which is easier to fill via a filling opening that the prior art units.

This is provided at least in part by the features of the characterizing portion of claim 1c. Additional advantageous features are provided in the dependent claims.

It should be noted that in the claims, a "filling opening having a central axis" is used. This should be understood in that the filling opening has an axis which is called the central axis. In the case where the filling opening is an elongated channel, the central axis should be defined as an average axis of the central portion of the elongated channel. If the elongated channel is straight, then the central axis would be equal to the longitudinal axis of the channel. In the case where the filling opening is not a channel, but rather just an opening in a plane surface, then the central axis should be defined as a normal vector to a plane comprising the filling opening. If the filling opening is not planar, then the central axis should be defined as a normal vector of a plane which comprises the most of the filling opening. In general, the central axis will also be aligned with the average direction in which water is poured into the filling opening.

The claims furthermore mention "the direction of the average direction of motion of the ice cube when the ice cube is removed from the tray". This should be interpreted as the direction which an ice cube formed in the tray would be removed from the tray. Usually, the ice cube tray is formed with ice cube compartments having an opening. Ice cubes are usually removed normal to the area of the opening. Ice cubes can often be removed in many different directions, but in general, the average motion of the ice cube needs to follow a certain vector. This is discussed in more detail below with reference to FIGS. 21*c* and 22*c*.

The claims also mention a "flexible material". By flexible material is meant a material which is flexible enough to deform when a pressure is applied to it. It should be clear to the person skilled in the art that all materials deform when enough pressure is applied, however, according to the current specification, the pressures which should be used are those which could be applied by a human user on a plastic unit.

The claims also use the terms, inner, outer, upper and lower. According to this specification, the terms inner and outer should be used to describe the direction which is parallel to the plane of the lid. The inner side is the side which is closest to the centre of the ice cube compartment whereas the term outer is further from the centre. The terms upper and lower should be used to describe the direction which is perpendicular to the lid. The term upper should be closest to the lid and the term lower should be farthest from the lid.

It should be emphasized that the term "comprises/comprising/comprised of" when used in this specification is taken to specify the presence of stated features, integers, steps or components but does not preclude the presence or addition of one or more other features, integers, steps, components or groups thereof.

Fourth Invention

The fourth invention relates to a sealed ice cube tray unit with a liquid filling opening, said ice cube tray unit comprising at least two individually sealed ice cube compartments, said liquid filling opening being associated with one of said at least two individually sealed ice cube compartments such that water introduced into the sealed ice cube tray unit through the liquid filling opening enters said ice cube compartment, said ice cube tray unit further comprising a divider between the at least two separately sealed ice cube compartments, and where at least a first opening is provided in said divider to allow water and/or air flow between said at least two ice cube compartments.

According to the current specification, a sealed ice cube tray unit should be understood as an ice cube tray and a removable lid which together provide a sealed compartment for forming at least one ice cube.

Furthermore, according to the current specification, the phrase "individually sealed" should be understood as meaning that one ice cube compartment should be individually sealed with respect to an adjacent ice cube compartment. The lid should therefore seal up against a divider between adjacent ice cube compartments. It should however, be noted that air/water channels located in the divider to allow water flow between adjacent ice cube compartments should be allowed. The limitation should be in that when the ice cube tray is sealed by the lid, the ice cube tray can be arranged in any position in a freezer without enough ice forming in the area between adjacent ice cubes which would make it difficult to break adjacent ice cubes away from each other in the unit. While the person skilled in the art should understand this definition, some more precise definitions are provided here which might be used if necessary. One definition is that the total cross sectional area of the air and/or water channels in the side wall should be less than 20% of the total surface area of the side wall of the ice cube compartment in which the air and/or water channels are located. Another definition is that the total cross sectional area of the air and/or water channels in the side wall should be less than 15% of the total surface area of the side wall of the ice cube compartment in which the air and/or water channels are located. Additional definitions with less than 10% and less 5% could also be used.

DESCRIPTION OF RELATED ART

Ice cube trays with water distribution channels are well known in the art. Usually ice cube trays are arranged with a number of ice cube compartments arranged in a 2D grid with each ice cube compartment having an upward facing opening. Water is usually poured into the ice cube tray via the open upper surface thereby filling the ice cube compartments. In order to make filling easier, it is often the case that small channels are provided in the walls dividing adjacent ice cube compartments so that water can flow from one ice cube compartment to another.

In the cases where no channels are provided, it is often the case that too much water is poured into the tray and the water flows over the dividers between the ice cube compartments. In this way, ice bridges are formed between adjacent ice cubes which makes it difficult to remove the ice cubes from the tray since the ice cubes firmly stick together. The use of channels also results in a bridge between adjacent compartments, but the size of the bridges can be controlled such that they are kept small enough so that they are easily broken when removing the ice cubes from the tray.

The use of water channels between adjacent ice cube compartments is well known. See for example U.S. Pat. No. 3,620,497A. Ice tube trays which are arranged with individually sealed ice cube compartments and which are filled via a sealing opening are however not so well known. Some examples are provided in WO2005054761A1 and U.S. Pat. No. 4,432,529A. In these examples, water channels are also provided between the adjacent ice cube compartments.

It should be noted that there is a large number of ice cube trays where the ice cube tray is sealed, but where the individual ice cube compartments are not individually sealed. For example DE8608582U1, EP1307694B1, EP2530413A2, GB1588108A, U.S. Pat. No. 4,883,251A, USD669102S1 and US2011278430A1 all disclose ice cube trays where water is poured into the tray via an opening until water reaches a predetermined fill line. Once the water reaches this line, a lid is placed on the ice cube tray. The ice cube tray is then arranged in a level position whereafter it is placed into a freezer in this level position. If the ice cube tray is not put into the freezer in the level position, the water will flow around in the container and one large ice cube will be formed instead of multiple separate ones in the tray. These types of ice cube trays can be described as sealed ice cube trays, but not as sealed ice cube trays with individually sealable ice cube compartments.

Prior art type sealed ice cube trays with separately sealed ice cube compartments have never been commercially successful. In general, this is because prior art solutions have not realized that filling a sealed ice cube tray via a filling opening is difficult since air stored in the sealed ice cube tray has to escape before water is able to be filled into the compartments.

Summary of the Fourth Invention

It is therefore a first aspect of the fourth invention to provide an ice cube tray as mentioned in the opening paragraph which is easy to fill.

This aspect is provided at least in part by the features of claim 1d. Additional advantageous features are provided in the dependent claims.

The claims use the term "central axis of the filling opening". This should refer to a vector which is either perpendicular to the area of the filling opening if the filling opening is a very thin opening) or parallel to the longitudinal axis of the filling opening if the filling opening has a certain length.

It should be emphasized that the term "comprises/comprising/comprised of" when used in this specification is taken to specify the presence of stated features, integers, steps or components but does not preclude the presence or addition of one or more other features, integers, steps, components or groups thereof. For example in the claims two individually sealed ice cube compartments are mentioned. This should be understood as at least two ice cube compartments.

Fifth Invention

The fifth invention relates to a sealed ice cube tray unit comprising an ice cube tray and a lid, said ice cube tray comprising two adjacent ice cube compartments, where each of said two ice cube compartments has a bottom and a sidewall, the sidewall being arranged such that the upper edge of the sidewall defines an opening through which an ice cube formed in the compartment can be removed and where said lid is mounted on said ice cube tray and is arranged to individually seal water or other liquid inside said ice cube compartments.

According to the current specification, a sealed ice cube tray unit should be understood as an ice cube tray and a removable lid which together provide a sealed compartment for forming at least one ice cube.

Furthermore, according to the current specification, the phrase "individually sealed" should be understood as meaning that one ice cube compartment should be individually sealed with respect to an adjacent ice cube compartment. The lid should therefore seal up against a divider between adjacent ice cube compartments. It should however, be noted that air/water channels located in the divider to allow water flow between adjacent ice cube compartments should be allowed. The limitation should be in that when the ice cube tray is sealed by the lid, the ice cube tray can be arranged in any position in a freezer without enough ice forming in the area between adjacent ice cubes which would make it difficult to break adjacent ice cubes away from each other in the unit. While the person skilled in the art should understand this definition, some more precise definitions are provided here which might be used if necessary. One definition is that the total cross sectional area of the air and/or water channels in the side wall should be less than 20% of the total surface area of the side wall of the ice cube compartment in which the air and/or water channels are located. Another definition is that the total cross sectional area of the air and/or water channels in the side wall should be less than 15% of the total surface area of the side wall of the ice cube compartment in which the air and/or water channels are located. Additional definitions with less than 10% and less 5% could also be used.

DESCRIPTION OF RELATED ART

Prior art ice cube trays are usually provided with multiple ice cube compartments arranged in a grid like structure. Most often ice cube trays are provided without lids and are open to the environment. Due to this, it is necessary to place ice cube trays in a freezer in a level position to prevent water or other liquid stored in the ice cube tray from pouring out.

There are examples of ice cube trays with lids which seal the contents of the ice cube tray. One such example is GB1588108A. However in prior art examples like these it is still necessary to arrange the ice cube tray unit in a level position in the freezer since otherwise the water will not be properly arranged in the ice cube compartments, but rather collect at one end of the unit and form a large clump of ice which is impossible to remove.

Ice cube tray units where the ice cube compartments are individually sealed are known in the prior art. One example is U.S. Pat. No. 3,135,101A and another example is DE10135206C2. However, common to these prior art solutions is that no proper consideration has been made which takes into account the expansion of water when it freezes. As the liquid freezes in the prior art examples, the ice will push against the lid thereby deforming the lid. In the case of U.S. Pat. No. 3,135,101A, the lid will be difficult to remove. In the case of DE10135206C2, the lid will deform allowing ice to form as a bridge between two adjacent ice cubes. This will make it difficult to remove the ice cubes from the tray as individual ice cubes. Two other examples of sealed ice cube trays are provided in U.S. Pat. No. 4,432,529A and in WO2005054761A1.

Summary of the Fifth Invention

It is therefore a first aspect of the fifth invention to provide a sealed ice cube tray unit as mentioned in the opening paragraph which is better than the prior art solutions.

This is provided by an ice cube tray unit as claimed in claim 1e. Additional advantageous features are provided in the dependent claims.

It should be emphasized that the term "comprises/comprising/comprised of" when used in this specification is taken to specify the presence of stated features, integers, steps or components but does not preclude the presence or addition of one or more other features, integers, steps, components or groups thereof. For example in the claims it is stated that the ice cube tray comprises two ice cube compartments. According to this specification this should be interpreted as at least two ice cube compartments. The same is true for two expansion absorbing portions.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

FIGS. 26*d* to 28*d* schematically show three views of another embodiment of a sealed ice cube tray unit according to the fourth invention.

DETAILED DESCRIPTION OF THE EMBODIMENTS

FIGS. 1-20 show different views of one embodiment of an ice cube producing/dispensing unit in different stages of operation. The ice cube producing unit of FIGS. 1-20 has a number of unique features which will be described in detail below. It should be obvious to the person skilled in the art that the different features do not all have to be used together. Other devices could be developed which make use of one or more separate features disclosed below. The scope of protection of the current application is to be determined by the claims of the current application.

It should be noted that the current application is one of a set of five applications all filed by the applicant on Oct. 6, 2014 at the Danish Patent and Trademark Office. The content of all five applications is incorporated by reference herein. The applications concerned are:

First invention: DK PA201470616—Filed Oct. 6, 2014
Second invention: DK PA201470615—Filed Oct. 6, 2014
Third invention: DK PA201470617—Filed Oct. 6, 2014
Fourth invention: DK PA201470619—Filed Oct. 6, 2014
Fifth invention: DK PA201470618—Filed Oct. 6, 2014

The embodiment of the ice cube producing unit 1 shown in the figures comprises a housing 2, a lid 3, a dispenser 4, two ice cube trays 5*a*, 5*b*, two tray lids 6*a*, 6*b* for the ice cube trays and an activation mechanism. The activation mechanism will be described in more detail below.

Figure 1:
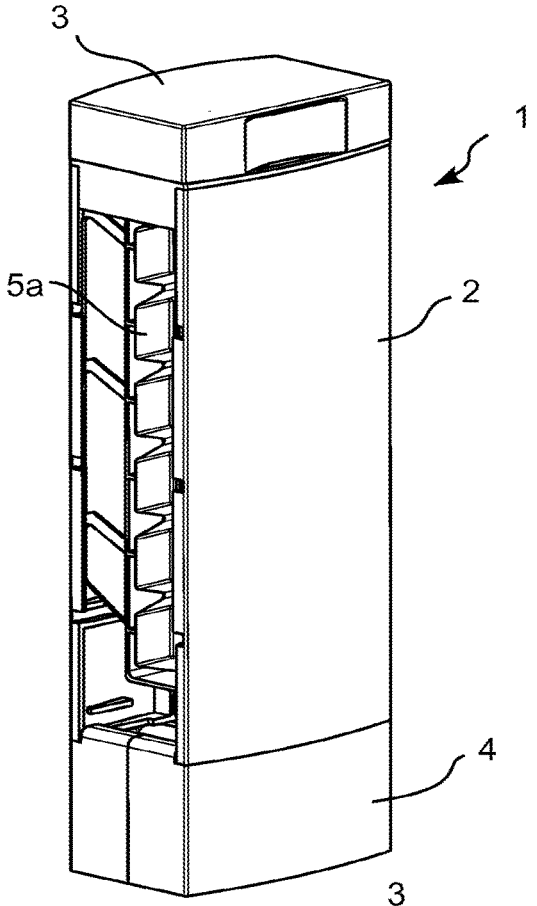
FIG. 1 shows a perspective view of a first embodiment of an ice cube producing unit according to the invention in a closed position.

FIG. 1 shows the unit in a closed position. In this position, the ice cube trays 5*a*, 5*b* are sealed by the tray lids 6*a*, 6*b* and no water/ice can get into the trays or leave the trays.

Figure 2:
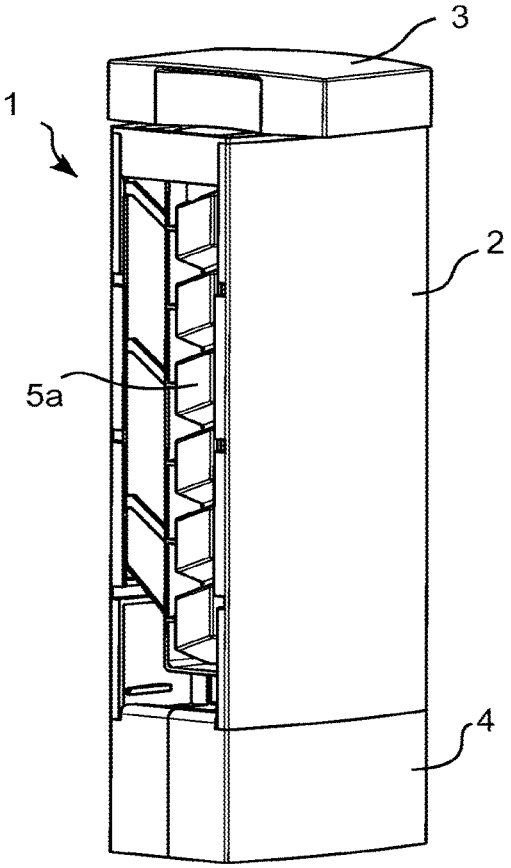
FIG. 2 shows a perspective view of the ice cube producing unit of FIG. 1 in a filling position.

FIG. 2 shows the unit in a filling position. In this position, the lid 3 has been turned 90 degrees to reveal filling openings 71, 72 (FIG. 18) in the top of the unit. In this position, water can be poured into the unit until it is full. Details of how the filling process works is provided below.

After filling the unit completely, the lid 3 can be turned 90 degrees back again to put the unit into its closed position (FIG. 1). The unit is then completely sealed and no water can then leave the unit. The unit can then be placed in a freezer in any position without water running out of the device. Once the unit is in the freezer, the water is allowed to freeze in the individual compartments of the ice cube tray.

Figure 3:
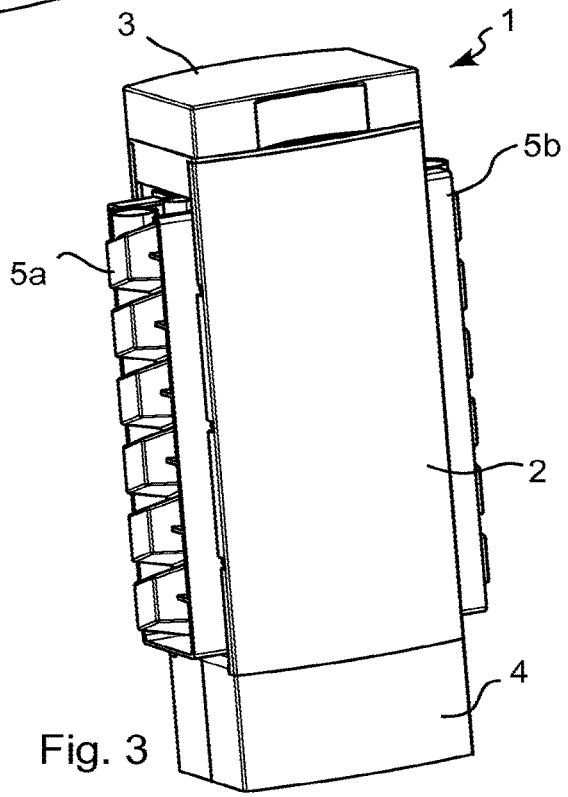
FIG. 3 shows a perspective view of the ice cube producing unit of FIG. 1 in a dispensing position.

FIG. 3 shows the device in a "dispensing" position. In this position, the lid 3 has been rotated a number of times thereby activating the opening mechanism. As the lid is rotated, the ice cube trays 5*a*, 5*b* are displaced outwards, thereby separating them from their respective tray lids 6*a*, 6*b*. Once the ice cube trays have been moved out enough, the ice cubes are released and they fall down in the interior of the unit. Further details of the opening mechanism are provided below.

In the current embodiment, further rotation of the lid activates the dispenser which dispenses one ice cube at a time out through the bottom of the unit. The operation is similar to a pepper mill. Further details of the dispenser are provided below.

Figure 4:
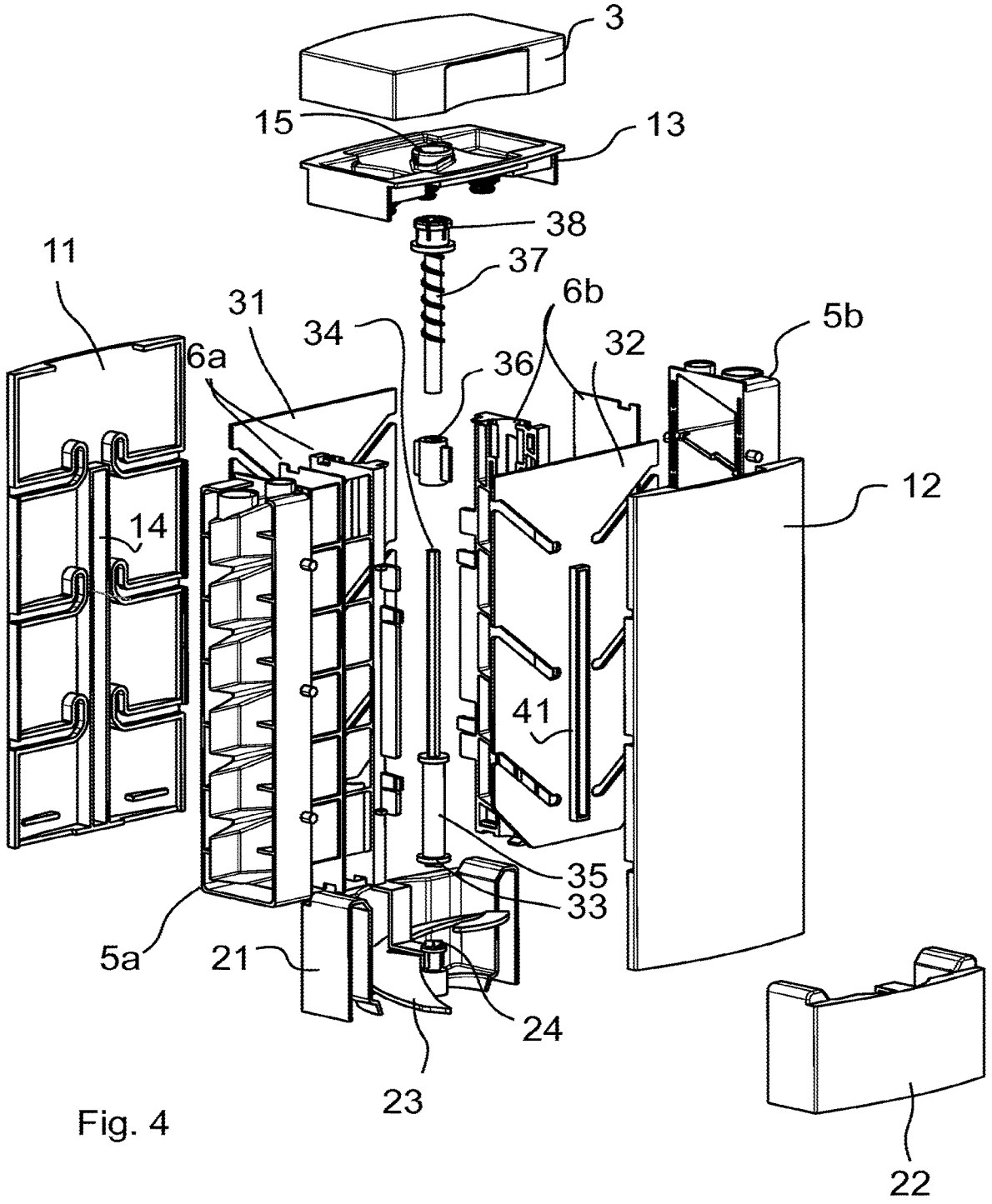
FIG. 4 shows an exploded perspective view of the ice cube producing unit of FIG. 1.
Figure 5:
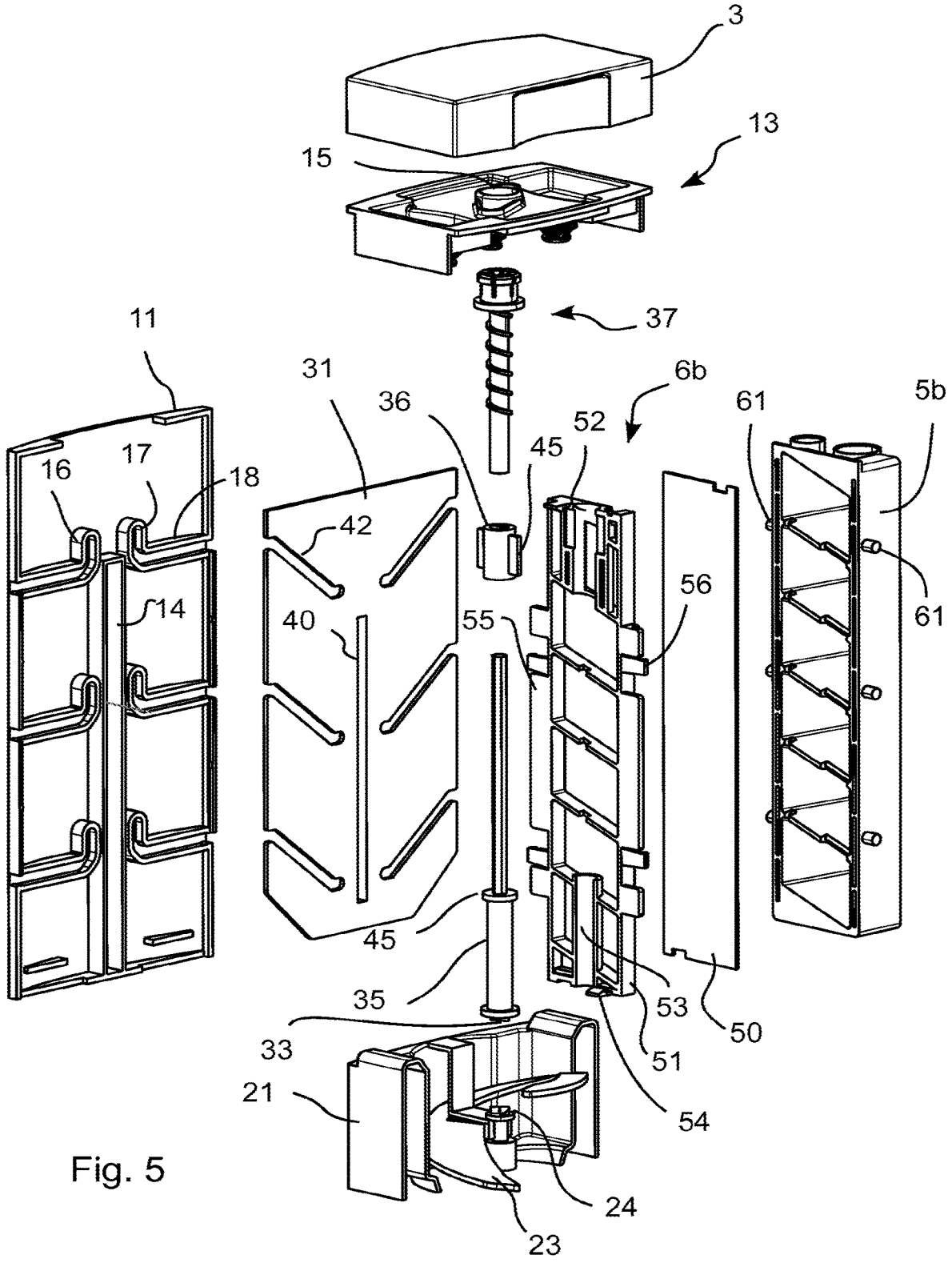
FIG. 5 shows an exploded perspective view of the ice cube producing unit of FIG. 1 where some of the components have been removed to simplify the drawing.

FIG. 4 shows an exploded view of the unit where all the different components can be seen. In FIG. 5 the left most tray with its associated tray lid, the foremost housing panel and the foremost panel of the dispenser have been removed to make understanding the mechanism easier.

Figure 6:
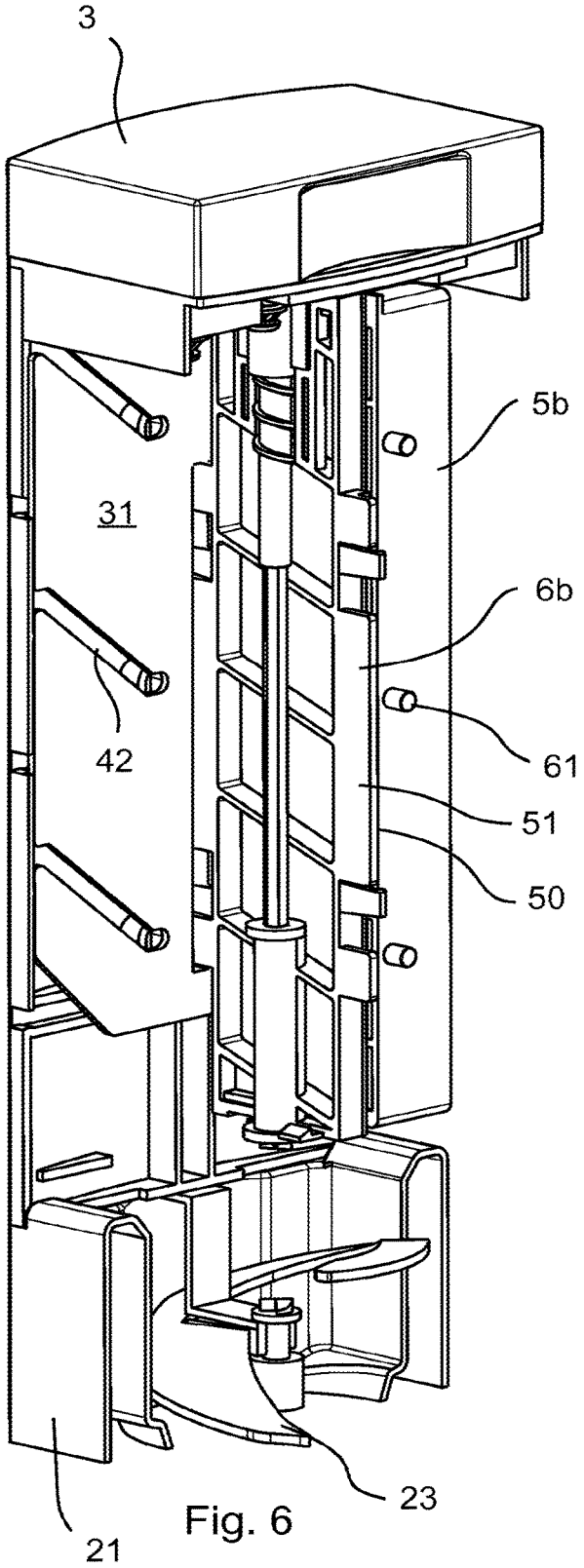
FIG. 6 shows a perspective view of the ice cube producing unit of FIG. 1 in a closed position where some of the components have been removed to simplify the drawing.
Figure 7:
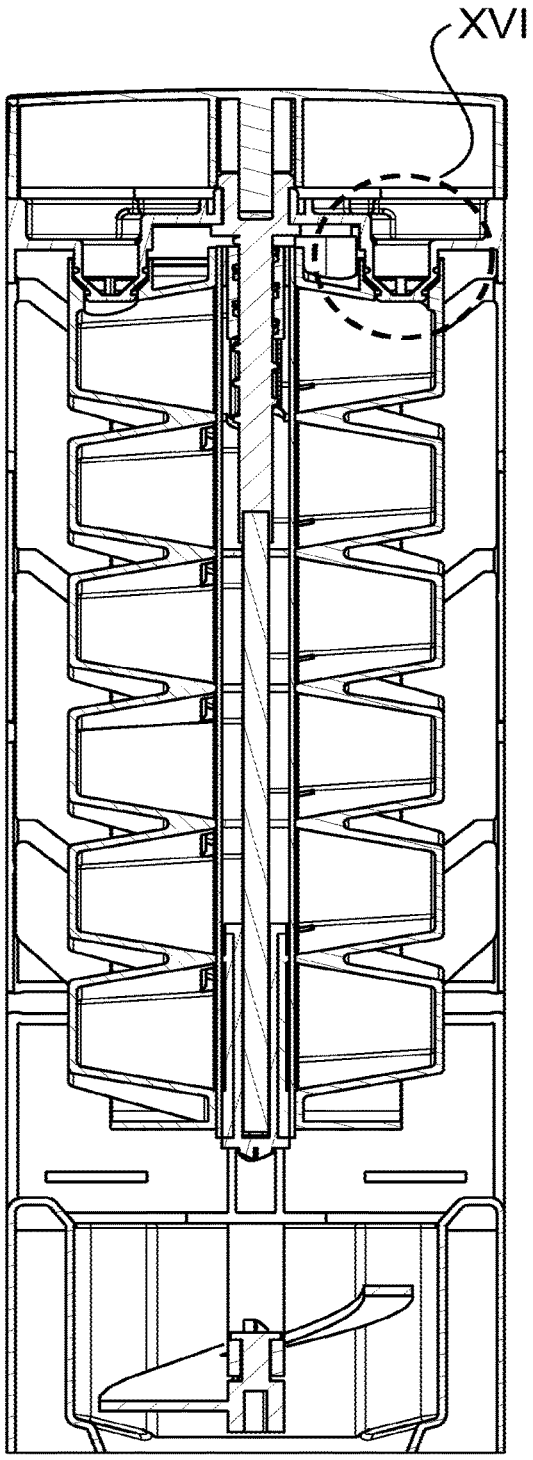
FIG. 7 shows a cross section view of the ice cube producing unit of FIG. 1 in a closed position.
Figure 8:
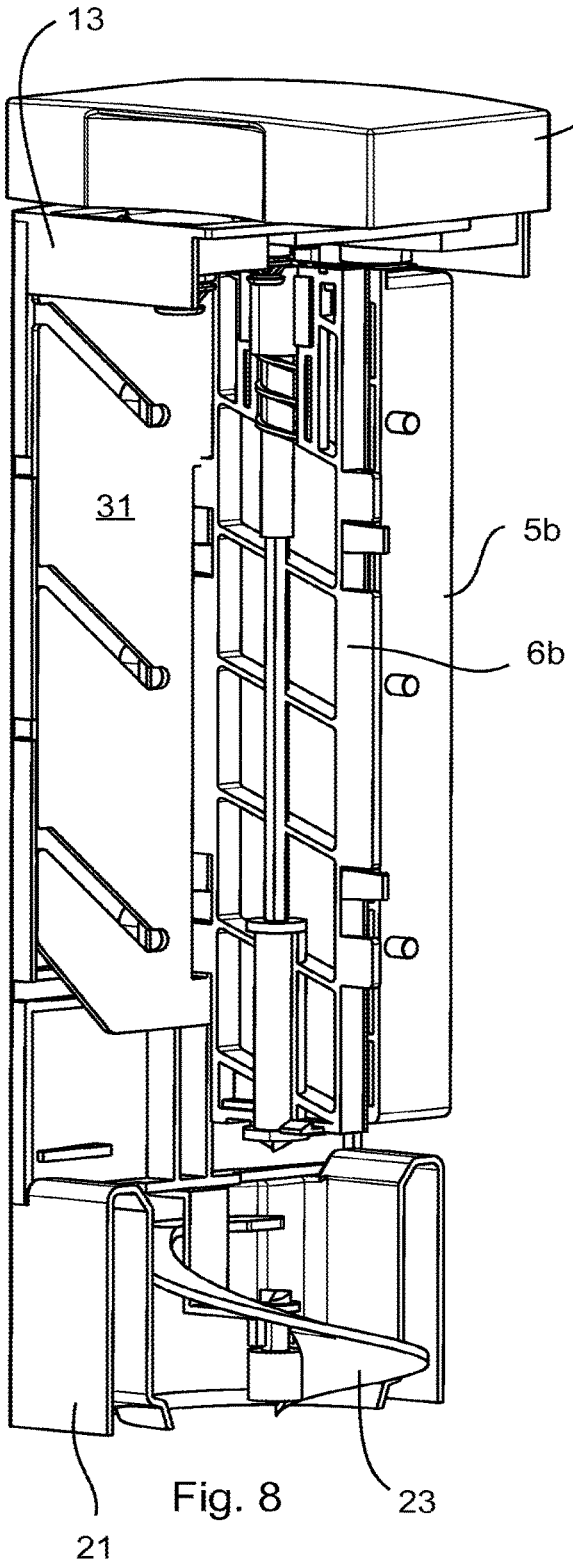
FIG. 8 shows a perspective view of the ice cube producing unit of FIG. 1 in a filling position where some of the components have been removed to simplify the drawing.
Figure 9:
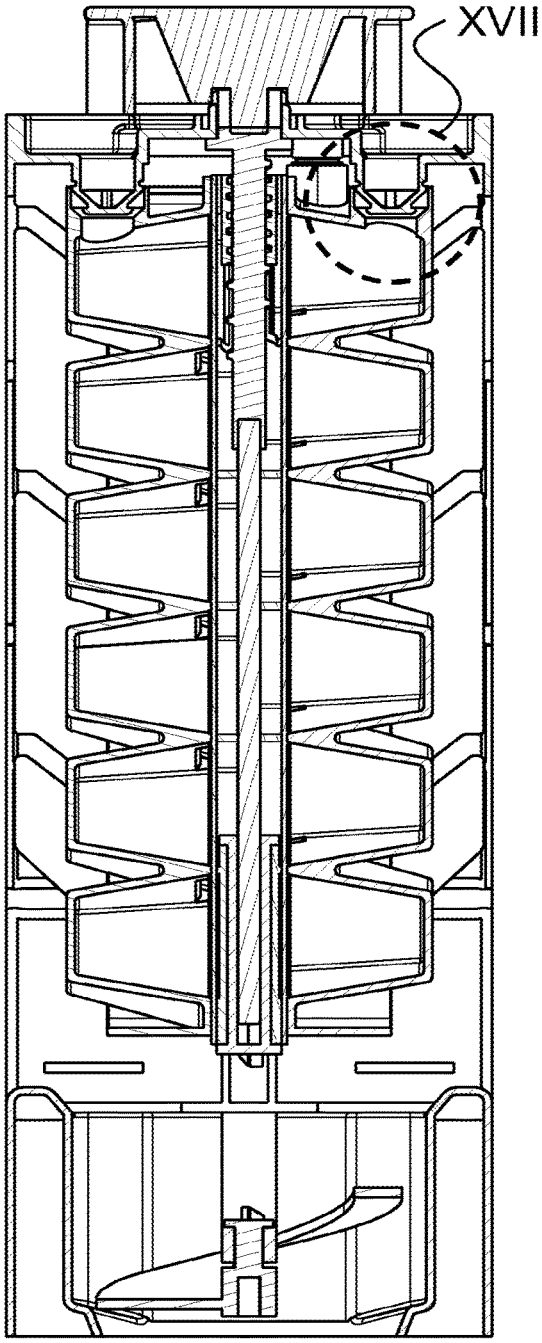
FIG. 9 shows a cross section view of the ice cube producing unit of FIG. 1 in a filling position.
Figure 10:
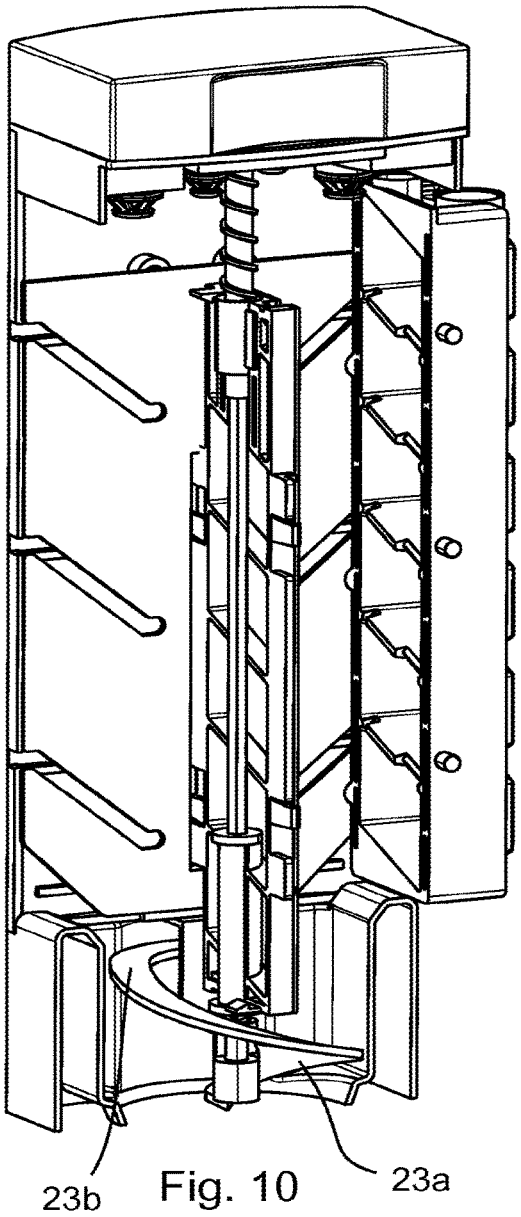
FIG. 10 shows a perspective view of the ice cube producing unit of FIG. 1 in a dispensing position where some of the components have been hidden to simplify the drawing.
Figure 11:
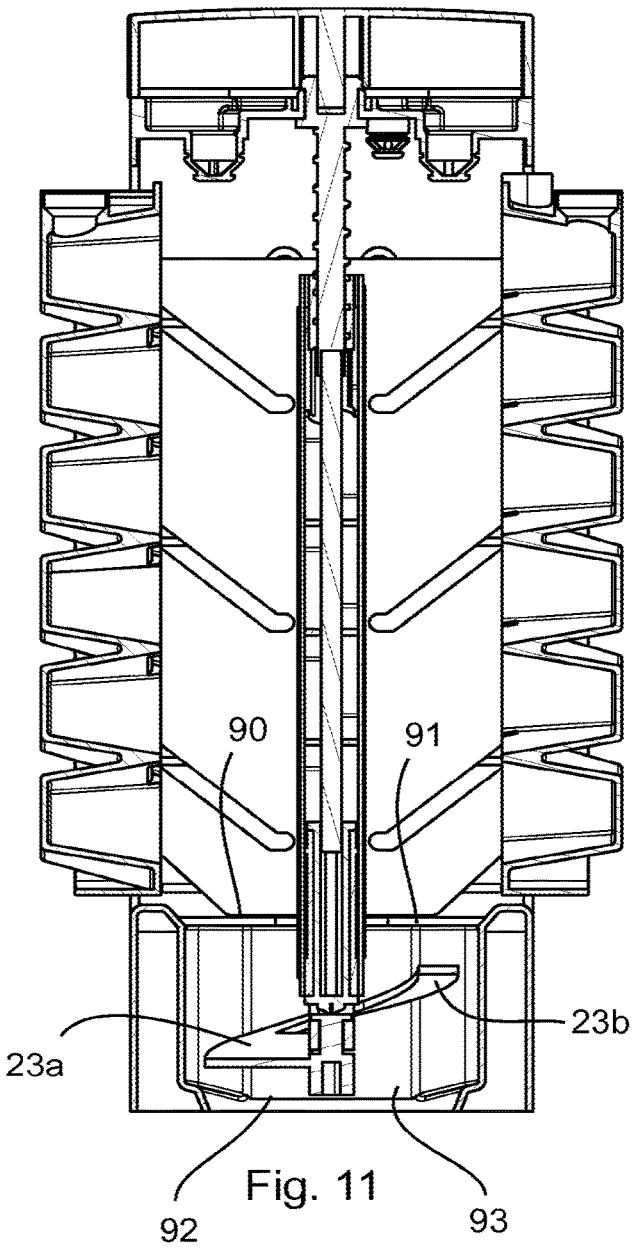
FIG. 11 shows a cross section view of the ice cube producing unit of FIG. 1 in a dispensing position.

FIGS. 6 and 7 show the unit in its closed position, FIGS. 8 and 9 show the unit in its filling position and FIGS. 10 and 11 show the unit in its dispensing position.

The unit, in more detail comprises (see FIG. 4), a first side housing panel 11, a second side housing panel 12, a top housing piece 13, a lid 3, a first dispenser panel 21, a second dispenser panel 22, a spiral element 23, a dispenser clutch element 24, a first tray 5*a*, a first tray lid 6*a*, a second tray 5*b*, a second tray lid 6*a*, a first guide plate 31, a second guide plate 32, a lid clutch element 33, a hexagonal drive axle 34, a bushing 35, a sliding nut 36 and a screw drive axle 37. The interaction between these elements will be described below.

It should be noted that in the current embodiment, the first and second tray lids 6*a*, 6*b* are made up of a flexible sheet element 50 and a frame element 51. The flexible sheet element is fastened to the frame element as will be described in more detail later on. The flexible sheet element is shown separated from the frame element in the figures for the sake of illustration, however in the actual device, the two elements would be fastened together to form a single unit.

During assembly, the sliding nut 36 is fastened to an upper recess 52 in the frame element 51 of the second tray lid 6*b*. The sliding nut is prevented from rotating or displacing with respect to the frame element. Furthermore, the bushing 35 is placed in a second recess 53 in the frame element of the second tray lid 6*b*. The bushing 35 is allowed to rotate with respect to the frame element of the lid, but is not allowed to displace with respect to the lid. This is due to the two flanges 45 on either side of the bushing 35 which sandwich a portion of the frame element. The opposite frame element of the tray lid 6*a* is then placed adjacent the frame element of the second tray lid 6*b* thereby sandwiching the sliding nut and the bushing inside the two tray lids. The two lids are each formed with a snap mechanism 54 which enable the two lids to snap together, thereby ensuring that the bushing 35 and the sliding nut 36 do not fall out of their recesses.

The frame elements of the lids also have vertically extending flanges 55 on either side of the tray lid. These flanges 55 are arranged in a vertical slot 40 arranged in the guide plates 31, 32. Snap elements 56 arranged parallel to the flanges 55 are arranged to snap onto the slot 40 in the guide plate 31, 32 to hold the glide plates and the lids together. In this way, when the lids are displaced, then the guide plates are also displaced in the same direction and the same amount.

From FIG. 4, it can also be seen that the guide plates have an elongated protrusion 41 around the periphery of the slot 40. This protrusion fits into a slot 14 in the first and second housing plates 11, 12. The slot 14 in the housing plates is longer than the protrusion 41 in the guide plates which allows the lids+guideplates assembly to slide up and down in the housing along the slot 14. It should be noted that other embodiments could also be provided. For example, in one solution, instead of having an elongated protrusion 41 which fits into a slot, the guide plate 31, 32 could be formed with a limited number of pins which fit into the slot 14 in the housing. In this way, any water trapped in the slot would be easily able to drain away. If there was some water trapped during freezing, the pins would easily break the ice.

In order to control the movement of the tray lid+guide plate assembly, the screw drive axle 37 is provided with an external thread which engages with an internal thread on the sliding nut 36. As the screw drive axle is rotated, the sliding nut is forced to displace up or down with respect to the screw drive axle depending on the direction of rotation of the screw drive axle. The upper portion 38 screw drive axle is snapped into an opening 15 in the housing top portion 13. The housing top portion is fastened to the first and second housing panels 12, 13. Due to the arrangement of the top portion of the screw drive axle, the screw drive axle cannot displace with respect to the housing panels and the housing top, it can only rotate. As it rotates, it will therefore force the lid+guide plate assembly to displace up or down with respect to the housing. A drive axle (not shown) below the lid 3 engages with the top portion of the screw drive axle 37, so that when the lid is rotated, the screw drive axle is also rotated. Therefore, by rotating the top lid 3, the lid+guide plate assembly is displaced with respect to the housing.

The ice cube trays 5*a*, 5*b* are each provided with three guide pins 61 on either side of the ice cube tray. The guide pins 61 are arranged in guide slots 42 in the guide plates and in guide slots 16 in the housing panels. The guide slots in the housing panels have a vertical portion 17 in towards the centre of the housing panels and a horizontal portion 18 which goes from the centre of the housing panels toward the outer periphery of the housing panels. The guide slots 42 on the guide plates 31, 32 are in general arranged at an angle to the vertical. In the current embodiment, the angle is around 40 degrees.

The ice cube trays 5*a*, 5*b* start in a position pressed tightly up against their respective tray lids 6*a*, 6*b*. The guide pins 61 of the trays are in the upper portion of the vertical portion of the guide slots 17 in the housing panels and in the innermost position in the guide slots 42 in the guide plates 31, 32. As the tray lid+guide plate assembly is pushed downwardly by rotating the lid 3, the guide pins are also pushed downwardly in the vertical portion 17 of the guide slots 16 in the housing panels while remaining stationary with respect to the slots in the guide plates. Once the guide pins reach the horizontal portion, the guide pins will start to move outwardly due to the angle of the guide slots in the guide plates. While the lid+guide plate assembly moves down, the ice cube trays move horizontally outwards. When the lid+guide plate assembly reaches the bottom of its travel, the external thread of the screw drive axle 37 releases the sliding nut and the lid+guide plate assembly stops moving downwards and the ice cube trays stop moving outwards.

When it is desired to retract the ice cube trays, the lid is rotated in the opposite direction thereby pulling the sliding nut upwards again and the motion of the trays and guide pins is reversed.

Once the tray lid+guide plate assembly reaches its lower most position, the lowermost portion of the bushing 35 which is formed as a clutch element 33 engages with a complementary clutch element 24 formed on the spiral 23. Since the screw drive axle 37 is no longer in engagement with the sliding nut, the screw drive axle is able to turn freely without any more displacement of the tray lid+guide plate assembly. The hexagonal drive axle 34 is fixed to one end of the screw drive axle and rotates together with the screw drive axle. The bushing 35 is arranged with an internal recess which matches the hex axles shape while still allowing the bushing to slide along the hex axle. In this way, as the lid+guide plate assembly is displaced downwardly, the bushing slides along the hex axle, but rotates together with the hex axle. Therefore, when the bottom of the bushing engages with the clutch element of the spiral, rotation of the lid will cause rotation of the spiral. The function of the spiral will be described in more detail later on.

FIGS. 10 and 11 shows the dispensing position in more details. As can be seen especially from FIG. 11, the ice cube trays have been displaced outwardly so that they are completely disconnected from the lids. The ice cubes are now free to fall down into the open area between the ice cube trays and the tray lids. In effect there are two separate compartments of ice cubes, one on either side of the tray lid assembly at the centre of the unit. The dispenser arrangement on the bottom of the device can be described as a unit having four openings, two openings 90, 91 at the top and two openings 92, 93 at the bottom. In effect, the two openings at the bottom are joined into one opening, however, one can imagine two separate openings.

In the position shown in FIG. 11, an ice cube will fall down through the left most opening 90 and land on the bottom portion of the spiral 23*a*. Likewise an ice cube will fall down through the right most opening 91 and land on the top portion of the spiral 23*b*. The spiral will prevent the ice cubes from falling out of the dispenser. As the spiral turns, the ice cube on the left and the ice cube on the right will slowly displace downwardly. When the end of the spiral is reached on the left hand opening, the ice cube on the left side will fall through the bottom opening 92 on the left side. Further rotation of the spiral will then allow the ice cube on the right to fall through the bottom opening 93 on the right side. This cycle can be repeated by further turning of the spiral.

In this embodiment, this effect is provided by having a spiral. However, a similar effect could be provided by two cover elements displaced apart from each other. In a first position, one cover plate covers the bottom opening while a second cover plate does not cover the top opening. In this position, an ice cube can fall through the upper opening and land on the lower cover plate. Rotating the cover plates then covers the upper opening while opening the lower opening. The ice cube can then fall out through the lower opening. Further rotation closes the bottom opening and opens the upper opening. This can be repeated as many times as desired.

While a spiral does not as such have a distinct upper and lower cover plate, in effect the top portion of the spiral acts as an upper cover plate and the lower portion of the spiral acts as a lower cover plate for the sake of this specification. Furthermore, the spiral could be formed with a smooth ramp as shown in the figures, or it can be provided with a stepped ramp if so desired.

FIGS. 12-15 show some different detail views of the ice cube trays 5 and the tray lids 6. As was mentioned previously, the tray lids 6 are in the current embodiment made up of a frame element 51 and a flexible sheet element 50. In the current embodiment, the frame element is made via an injection moulding process in plastic and the flexible sheet element is co-injected directly onto the frame element with a rubber material. In this way, the tray lids are formed as a single component in a single production process.

Figure 15:
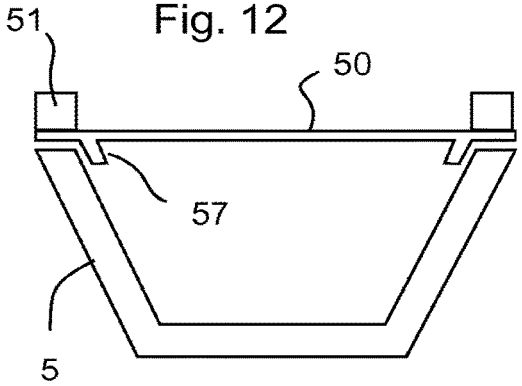
FIG. 15 shows a schematic view of the tray and tray lid with sealing ribs.
Figure 13:
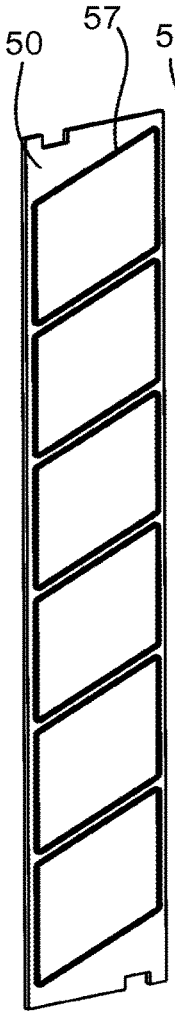
FIG. 13 shows a perspective view of the flexible sheet of FIG. 12 from a different viewing angle.

On the tray facing side of the flexible sheet element 50, sealing lips 57 are formed. FIG. 15 shows a schematic view of the sealing lips to better illustrate how they work. The sealing lips extend a short distance into the ice cube compartment along the upper edge of the ice cube compartment. The sealing lips have two purposes. A first purpose is to provide a better seal which can absorb a certain amount of extension of the flexible sheet element when the ice in the compartment expands without the water in the ice cube flowing over the edges of the ice cube compartment. In order to improve sealing effect of the sealing lips ridges or extra flaps could be formed on the outer sides of the sealing lips so that a better seal is provided between the sealing lips and the inner surface of the ice cube compartment.

A second purpose is to help pull the ice cube out of the ice cube compartment when the tray is pulled away from the tray lid. When the ice freezes in the ice cube compartment, the ice will freeze around the slightly inwardly sloping sealing lips. When the tray is pulled away from the tray lid, the sealing lips will try to hold on to the ice cube, thereby pulling it out of the tray. When the sealing lips pass the upper edge of the tray, then they flex outwardly thereby releasing the ice cube.

Depending on how hard the sealing lips should grip the ice cube, the sealing lips could be formed in different shapes and sizes. It can also be seen that due to the motion of the trays and lids, as the trays go straight out, the tray lids go down. Therefore in the case where the ice cubes are held onto the lid via the sealing lips, the downward motion of the tray lids with respect to the trays will force the trays into contact with the ice cubes, thereby rotating the ice cubes and forcing them to fall away from the tray lids.

Figure 12:
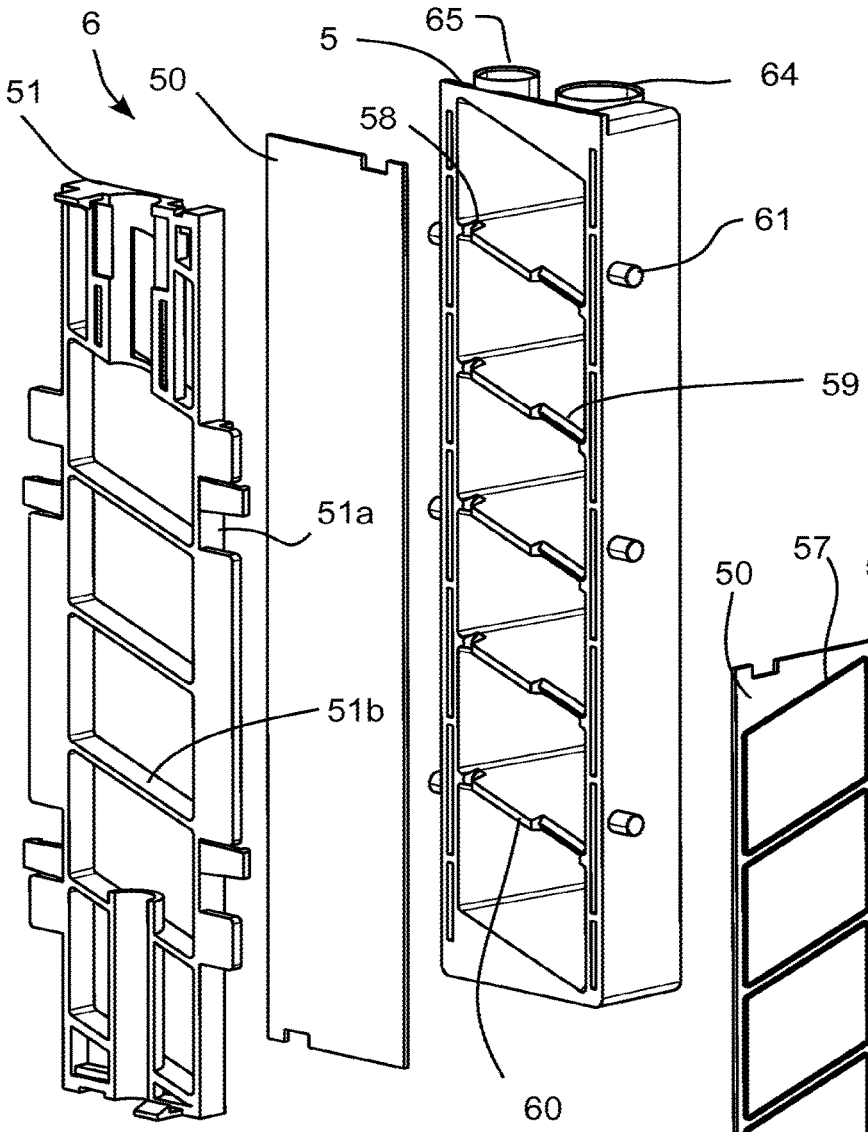
FIG. 12 shows an exploded perspective detail view of the ice cube tray component with tray lid of the ice cube producing unit of FIG. 1.
Figure 14:
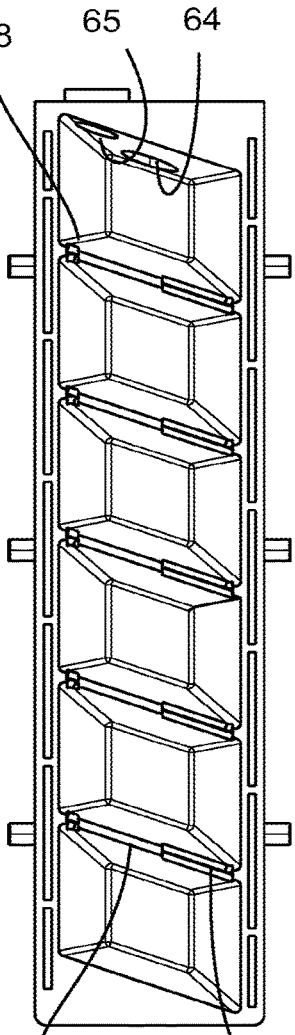
FIG. 14 shows a front view of the ice cube tray of the ice cube producing unit of FIG. 1.
Figure 16:
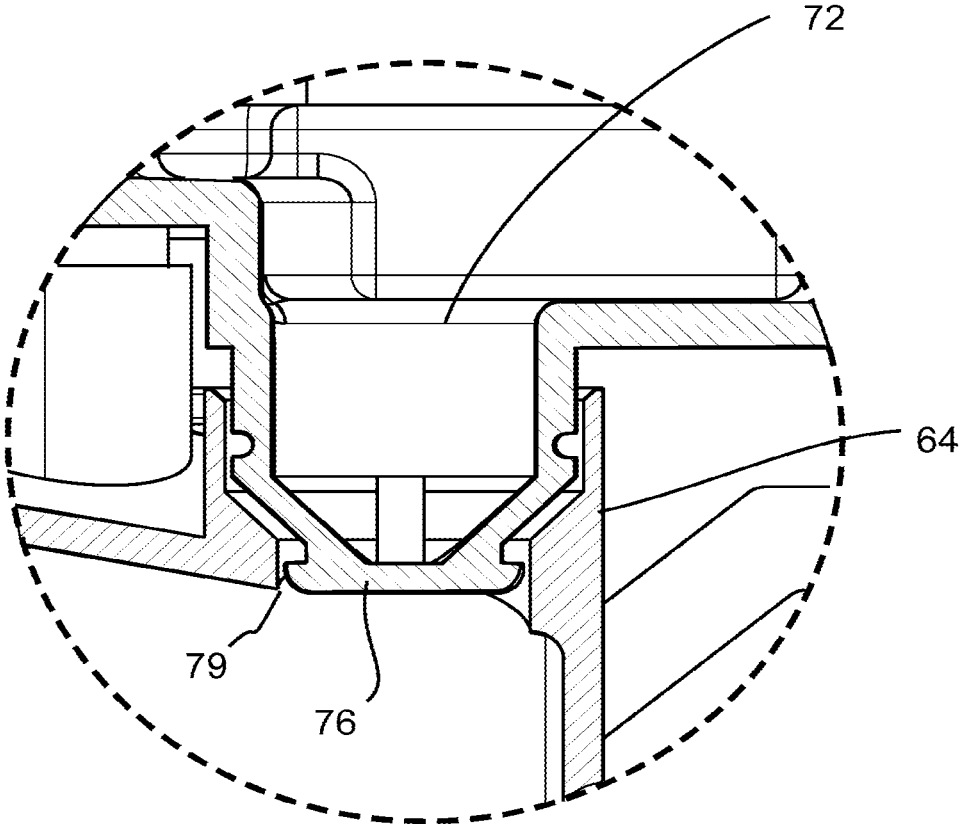
FIG. 16 shows a close up cross section view of the filling opening in a closed position according to the detail view XVI defined in FIG. 7.

As can also be seen especially from FIGS. 12 and 14, the ice cube tray 5, has a number of channels 58, 59 in the dividers 60 between adjacent ice cube compartments. Furthermore, it can be seen that the dividers between the A small channel 58 is provided at the top end of the divider and a larger channel 59 is provided at the lower end of the divider. Due to the sloping divider, as water is poured into the ice cube tray via the filling opening 64, water will flow on one side of the ice cube tray through the larger opening 59 while air will be able to leave through the smaller channels at the upper end of the dividers. In this way, the water flow will be arranged on the right side of the tray while air flow will be arranged on the left side of the tray. Due to the separation of the air flow and water flow to the left and right sides respectively, air bubbles in the water flow will be avoided, thereby allowing a faster and easier filling of the ice cube tray.

It can also be noted that the frame element 51 is arranged with an outer frame 51*a* which presses the flexible sheet against the outer periphery of the ice cube tray. Furthermore, the frame element 51 is arranged with dividers 51*b* which press the flexible sheet against the upper edge of the dividers of the ice cube compartments. In this way, a tight seal is provided between the flexible sheet and the upper edge of the ice cube tray. Furthermore, it can be seen that the frame element is hollow between the outer frame and the dividers. In this way, as the water in the ice cube compartments freezes, the flexible sheet will be allowed to extend into the hollow between the outer frame and the dividers.

As mentioned previously, in order to fill the unit with water, the unit can be put into a filling position by rotating the lid 90 degrees. Likewise, it was mentioned that by rotating the lid back 90 degrees, the unit can be sealed to prevent water from running out of the unit. The closed position can be seen best in the cross section of FIG. 7 and in the detail view of FIG. 16. Likewise the filling position can best be seen in FIG. 9 and the detail view of FIG. 17. Further details of the filling arrangement can be seen in FIGS. 18-20.

In general, the top housing part 13, is provided with two filling openings 71, 72 and two air vent openings 73, 74. One set of filling opening 71 and air vent opening 73 is associated with a filling opening 62 and an air vent opening 63 on the first tray 5*a* and the second set of filling opening 72 and air vent opening 74 is associated with a filling opening 64 and an air vent opening 65 of the second tray 5*b*. Water can then be poured into the unit via the filling openings and air vents out through the air vent openings.

Figure 17:
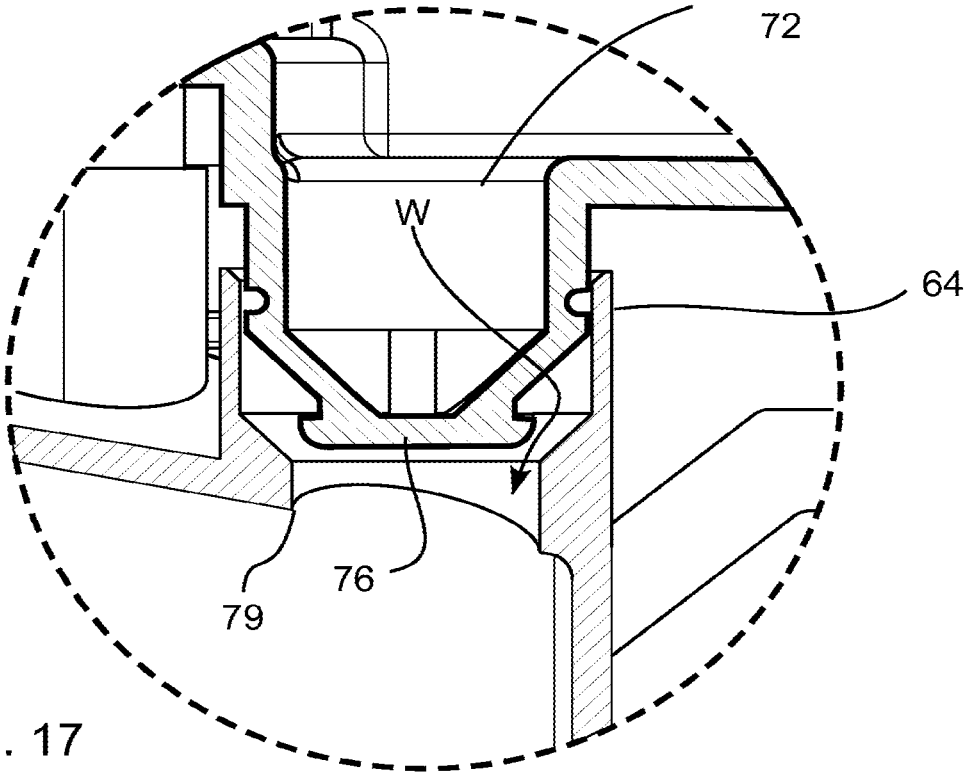
FIG. 17 shows a close up cross section view of the filling opening in an open position according to the detail view XVII defined in FIG. 9.
Figure 18:
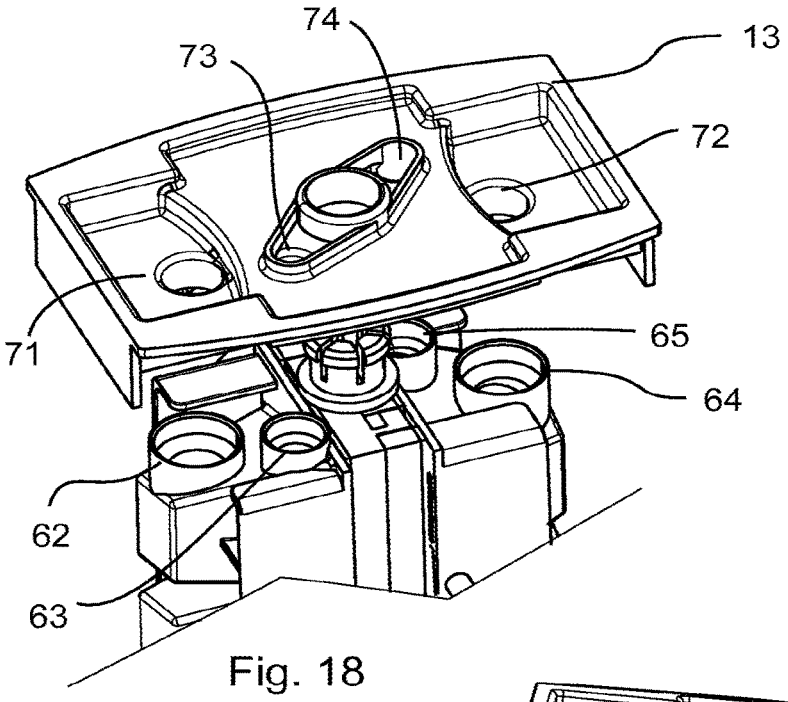
FIG. 18-20 show different perspective views of the filling arrangement of the ice cube producing unit of FIG. 1.
Figure 19:
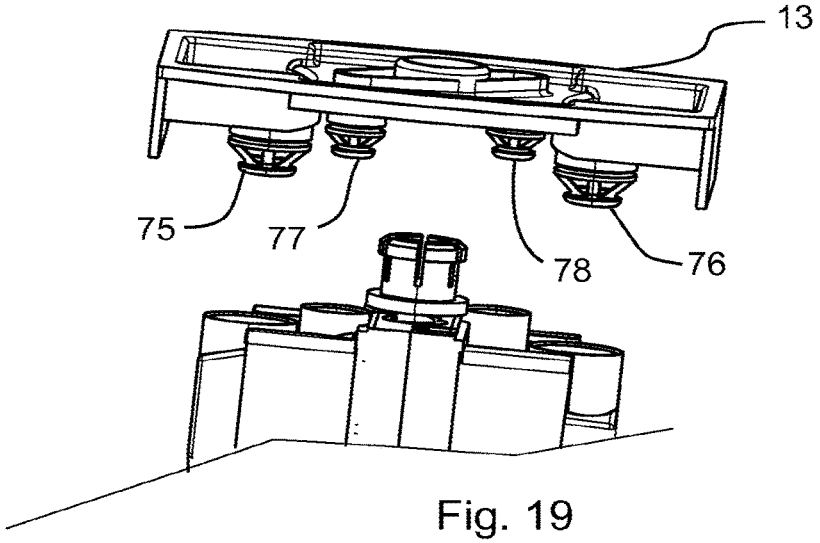
Figure 20:
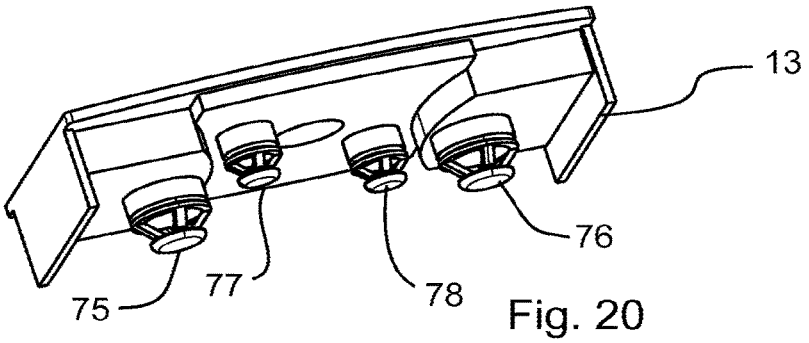

A sealing element 75, 76, 77, 78 associated with each opening in the top housing part 13 is provided which can be inserted into the respective opening of the tray. When the unit is in its filling position, the sealing elements are retracted as shown in FIG. 17. The water flow is shown by the arrow with the label W. When the unit is in its closed position, the sealing elements are pressed down into the openings in the trays, thereby sealing the openings in the trays. See FIG. 16.

It should be noted that in the closed position of the sealing elements, the sealing element is arranged such that it fills the majority of the filling opening. In this way, when the ice cube is to be removed from the tray, there is no portion of the ice cube which sticks out of the tray such that it cannot be removed from the tray. While a small portion of the ice cube in this embodiment sticks into the filling opening, this portion of the ice cube is still located on the inside of the outermost edge 79 of the filling opening due to the taper on the side wall of the ice cube compartment.

It should also be noted that in the current embodiment, two o-rings (not shown) are provided on the sealing element, one on the bottom portion in the recess provided for this purpose and one on the upper portion, again in the recess provided for this purpose. It can be seen that in the closed position, both o-rings are in engagement with the opening. In contrast in the filling position, the lower o-ring is free from engagement while the upper o-ring is still in engagement with the opening. In this way, water poured into the filling opening is directed into the tray and not into the internal mechanism of the unit.

It should be noted that by rotating the lid 90 degrees, the screw drive axle 37 causes the trays and the tray lids to displace downwardly enough to disengage the sealing elements from the filling and venting openings.

As mentioned previously, the current application is related to at least five main inventions related to an ice cube producing/dispensing unit. In the description above, one specific embodiment has been described in detail. However, in the following description, some other embodiments of an ice cube producing/dispensing unit will be described in a very schematic manner with more details as to the five main inventions of this specification.

It should be noted that in the sections below, the reference numerals used will in certain cases overlap between the sections relating to the different inventions. However, it should be clear from the description to which figure is being referred. All the figures are given subscripts a, b, c, d or e to refer to the figures related to the first, second, third, fourth and fifth main inventions respectively.

First Invention

Figure 21A:
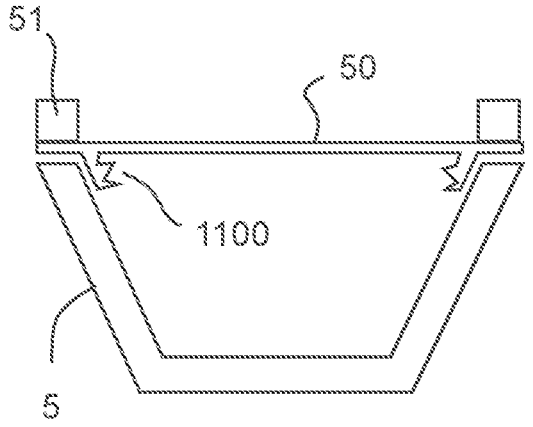
FIG. 21*a* shows a schematic cross section view of an ice cube compartment with a lid having ice cube holding means.

FIG. 21*a* shows another schematic example of an ice cube tray 5 with a lid 50, 51 according to the invention. As with the previous embodiment, the lid is made up of a frame element 51 and a flexible sheet element 50. And as with the previous embodiment, sealing lips 1100 are provided on the bottom side of the lid. As with the previous embodiment, the sealing lips 1100 act both as sealing lips and as ice cube holding means whereby the ice cube is positively engaged with the sealing lips of the lid so that when the lid is pulled away from the ice cube tray, the ice cube will want to follow the lid. In this embodiment, the sealing lips 1100 are formed with protrusions on the inner side of the sealing lip to more positively engage the ice cube. The sealing lips can be formed in many different ways. For example, by making the sealing lips very flexible, as soon as the ice cube is pulled just slightly out of the tray, then the sealing lips will disengage the ice cube and the cube will be free of the lid. By making the sealing lips stiffer and/or with more positive engagement means, then the ice cube will be more difficult to separate from the lid. In general, the sealing lips can be arranged as flexible sealing elements which are arranged to positively engage an upper surface of an ice cube formed in the ice cube compartment. In this case, the sealing function and the holding function are combined in one element.

However, it could also be possible to arrange the holding elements away from the edge of the ice cube compartments without any sealing lips at all. For example, small engagement elements, for example small flexible barbs, could be arranged at the centre of each ice cube compartment. Or one could imagine sealing lips with no holding function. For example, if the sealing lips had no positive engagement with the ice cube, then pulling the lid away from the tray would just pull the sealing lips out of engagement with the ice cube.

Figure 22A:
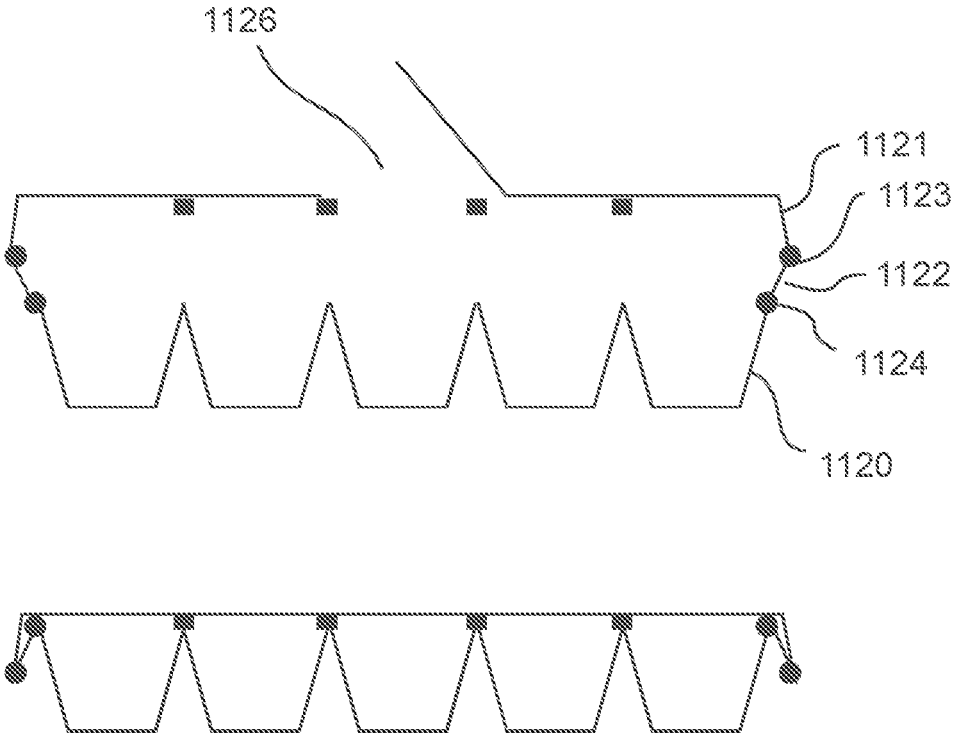
FIG. 22*a* shows a schematic cross section view of a second embodiment of an ice cube producing unit according to the first invention.

FIG. 22*a* shows a second embodiment of an ice cube producing unit according to the current invention. This is a much simpler embodiment than shown previously. In this case the unit comprises an ice cube tray 1120 and a lid 1121. The lid and the ice cube tray are joined by a flexible rubber element 1122 which is bendable about its upper edge 1123 and its lower edge 1124. The flexible rubber element is formed as a bi-stable element having the two positions shown in FIG. 22*a*. When it is in its lower position, the lid is sealed against the tray and when it is in its upper position, the lid is away from the tray. The ice cubes can then be shaken out of the tray and out of the opening 1126. In this embodiment, the displacing arrangement can be understood as the flexible rubber element 1122 and its edges 1123, 1124. Furthermore, in this embodiment, the "housing" could be understood as the combination of the lid, the flexible rubber element and the ice cube tray.

In another embodiment, not shown, magnets could be used to hold the position of the lid in its first and second position respectively. In the first position, the magnets could hold the lid against the tray to seal the contents of the tray. In the second position, magnets placed on an outer position of a suitable housing could hold the lid away from the tray so that the ice cubes can be removed.

Second Invention

Figure 21B:
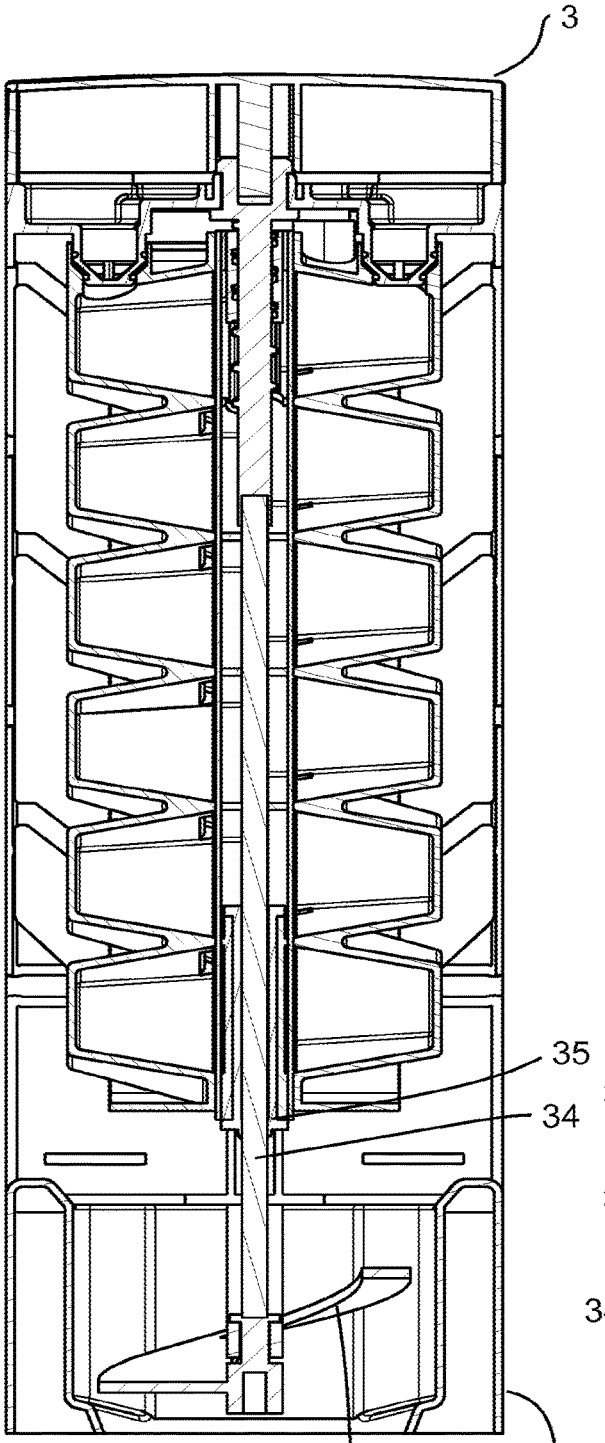
FIG. 21*b* shows a cross section view of a second embodiment of an ice cube dispensing unit according to the second invention in a closed position.

FIG. 21*b* shows a second embodiment of an ice dispensing unit which is very similar to the one described above with respect to FIGS. 1-20. However, in contrast to that embodiment, the hex axle 34 is extended to directly engage the spiral. In this way, the clutch elements of the previous embodiments can be avoided. It can be seen that as in the previous embodiment, the bushing 35 still slides on the hex axle 34, however, it is no longer necessary to have a clutch element on the bottom of the bushing.

Figure 22B:
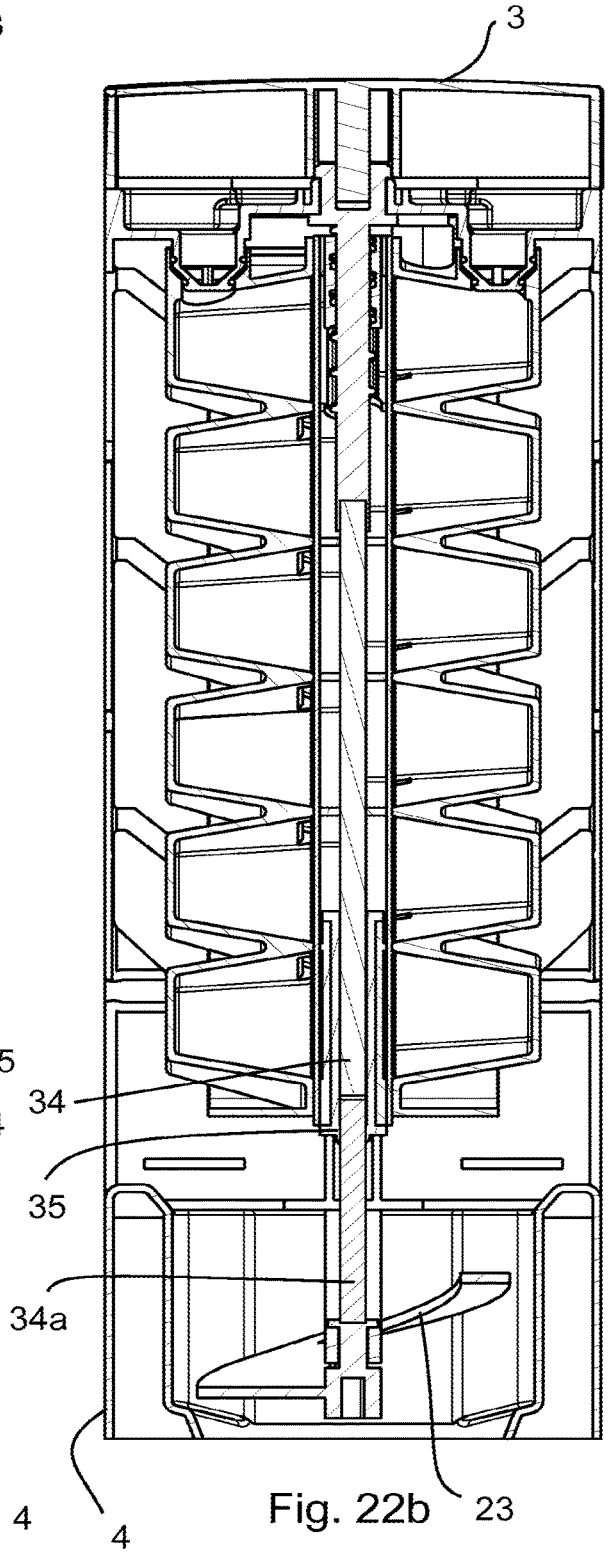
FIG. 22*b* shows a cross section view of a third embodiment of an ice cube dispensing unit according to the second invention in a closed position.

FIG. 22*b* shows a slightly different embodiment. Instead of the hex axle 34 extending all the way down to the spiral, a second hex axle 34*a* is connected to the spiral and engages with the bushing 35. As the hex axle 34 turns, the bushing 35 turns which also turns the second hex axle 34*a*. In this way, one can remove the entire dispenser unit 4 at the bottom of the unit without any axles protruding from the housing.

Figure 23C:
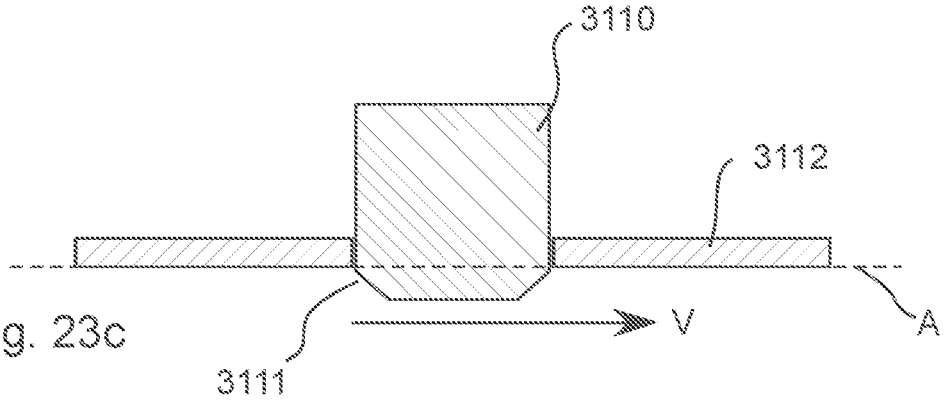
FIG. 23*c* schematically shows another embodiment of a filling opening and a plug.
Figure 23D:
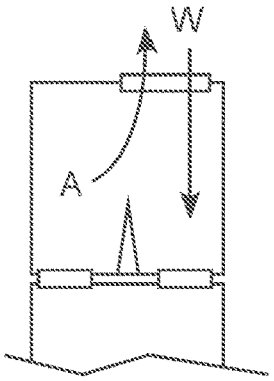
FIG. 23*d* schematically shows a modification of the sealed ice cube tray unit of FIG. 22*d*.
Figure 23E:
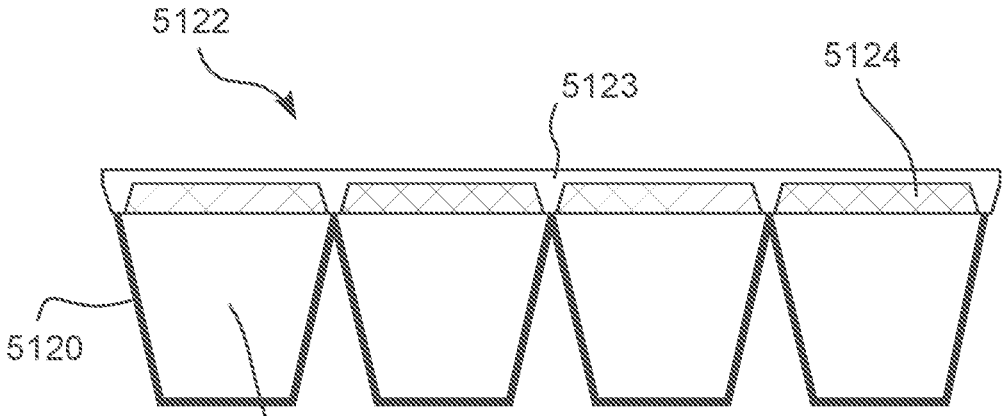
FIG. 23*e* schematically shows another embodiment of a sealed ice cube tray unit according to the fifth invention.
Figure 23B:
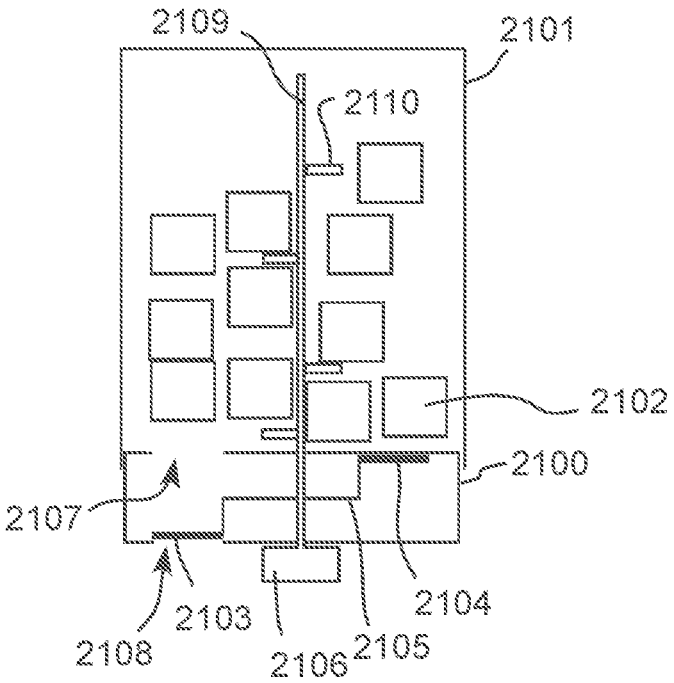
FIG. 23*b* shows a schematic cross section view of a fourth embodiment of an ice cube dispensing unit according to the second invention in a closed position.

FIG. 23*b* shows a schematic view of a low cost dispenser unit 2100 which could be attached to a prefilled container 2101 of ice cubes 2102, for example a plastic bottle filled with ice cubes. In this schematic example, the bottle is circular in diameter and the dispenser unit is also circular in diameter. The inner edge of the container could be formed with an inner thread and the dispenser unit could be formed with an external thread which can be screwed into the container. Instead of a thread, a snap fit arrangement could be provided.

A lower cover plate 2103 and an upper cover plate 2104 are attached to a rotor 2105. The rotor is activated by rotating a handle 2106. The upper cover plate 2104 is arranged to cover an upper opening 2107 in the dispenser and the lower cover plate 2103 is arranged to cover a lower opening 2108.

It can also be seen from the figure that the handle 2106 could be attached to an axle 2109 which extends up through the body of the container. Agitating elements 2110 in the form of small rods are attached to the axle 2109. As the handle is rotated, the axle rotates and the small rods are driven through the ice cubes to agitate them. This prevents the ice cubes from freezing together. In another embodiment, instead of small rods, the axle could be formed with a spiral element on the axle such that when rotated, the spiral element will slowly shift the ice cubes in the container. Due to the spiral shape, it will be easier to rotate the axle than a situation with rods. In the situation where the ice cubes should freeze together, the agitating elements are also used to break the ice cubes apart.

This mechanism could be called an ice cube agitating mechanism. In another example, the agitating mechanism could be moved up and down instead of rotated. Said agitating mechanism could be an axle which extends at least a portion of the way through the housing and where agitating elements could be connected to the axle so that when the axle is displaced, for example rotated or moved up and down, the agitating elements agitate the ice cubes in the housing.

In another embodiment (not shown) a unit much like the unit of FIG. 23*b* could be provided, but where the handle is arranged at the top of the unit instead of the bottom as in FIG. 23*b*. Furthermore, in another embodiment (not shown), an axle could be fixed to the container 2101. The dispenser portion could then be rotated with respect to the container which would cause the openings 2107 and 2108 to rotate with respect to the cover plates.

In the embodiments shown previously, the cover plates/spiral is rotated. However, in another embodiment, the cover plates could be displaced linearly instead. FIG. 24*b* shows an example of a linear displacement dispensing assembly 2120. In this example, the ice cubes 2122 are arranged in a rectangular housing 2121, similar to the one shown in the first embodiment described herein. The left and right figures show the two positions of the dispensing mechanism. As with the previous embodiment, the dispensing assembly has a top opening 2123, a bottom opening 2124, a top cover plate 2125 and a bottom cover plate 2126. A displacing mechanism 2127 pushes the cover plates to the left to uncover the top opening thereby adding an ice cube to the dispensing assembly. When the displacing mechanism is released, the ice cube drops out of the dispensing assembly.

In the embodiment shown in FIG. 24*b*, no agitating mechanism is shown. However, the housing itself could be formed from a flexible plastic material which can be twisted and bent by the user. For example a thick rubber material which holds its shape well, but allows the housing to be twisted. When the housing is bent and twisted, the ice cubes will be agitated thereby breaking any freeze bonds between ice cubes.

Third Invention

Figure 21C:
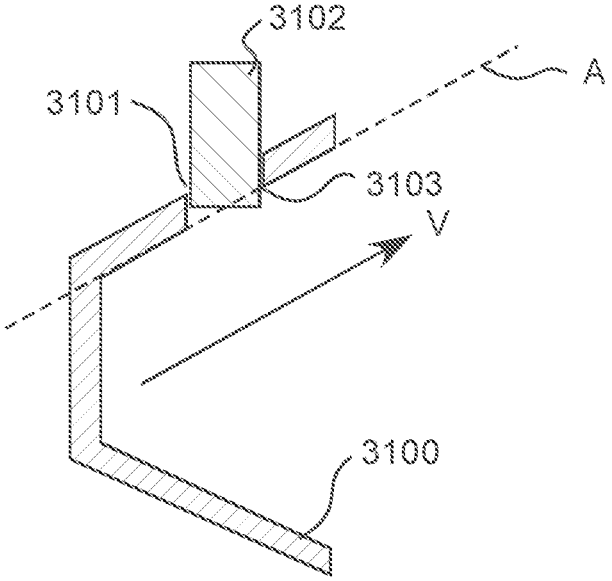
FIGS. 21*c* and 22*c* show schematic views of an ice cube tray with a filling opening and a plug.
Figure 22C:
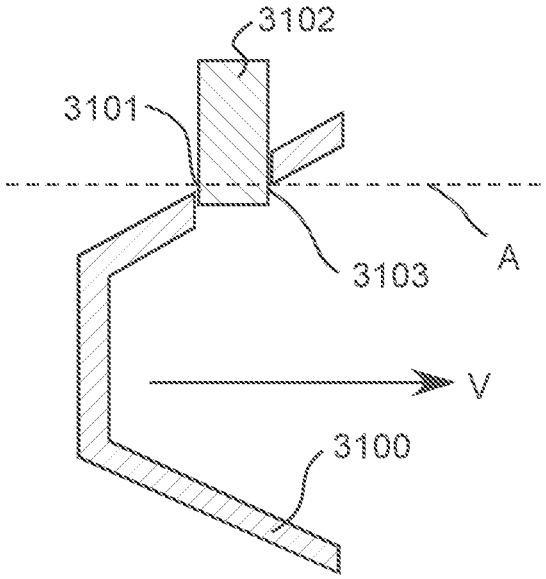

FIGS. 21*c* and 22*c* show a single ice cube compartment 3100 and a filling opening 3101 in the side of the ice cube compartment. A plug 3102 is arranged in the opening to plug the opening. The two figures show two vectors V which show two directions in which the ice cube could be removed from the tray. Other directions are also possible as will be obvious to the person skilled in the art. The filling opening and the plug should be arranged such that the plug completely fills the volume of the filling opening which is arranged outside a plane A comprising a vector which starts at the outermost edge 3103 of the filling opening and points in the direction of the average direction of motion V of the ice cube when the ice cube is removed from the tray. As can be seen from FIG. 21*c*, this is not fulfilled whereas in FIG. 22*c* this is fulfilled. According to the claims, it is not necessary that the condition is fulfilled for each direction of motion, just one direction of motion. It can also be seen from FIG. 21*c*, that if one should try to remove the ice cube from the compartment along the direction V, then the ice which is formed in the volume outside the plane A would crash into the outermost edge of the filling opening and prevent removal of the ice cube from the tray. However, in FIG. 22*c*, this is no problem since no ice is formed outside the plane A.

FIG. 23*c* shows an example of a plug 3110 which completely fills a filling opening 3111 in a sidewall 3112 of an ice cube tray. When the plug is removed from the opening, no ice is left in the opening. This ensures that it is easy to remove the ice cube from the tray once the plug is removed. As can be seen the inner side of the plug is tapered to ensure that it is easy to remove the plug from the filling opening.

Figure 24C:
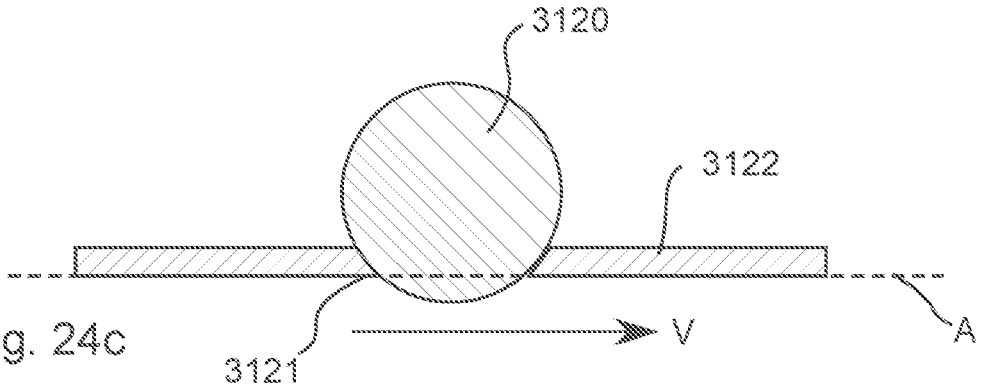
FIG. 24*c* schematically shows another embodiment of a filling opening and a plug.
Figure 24B:
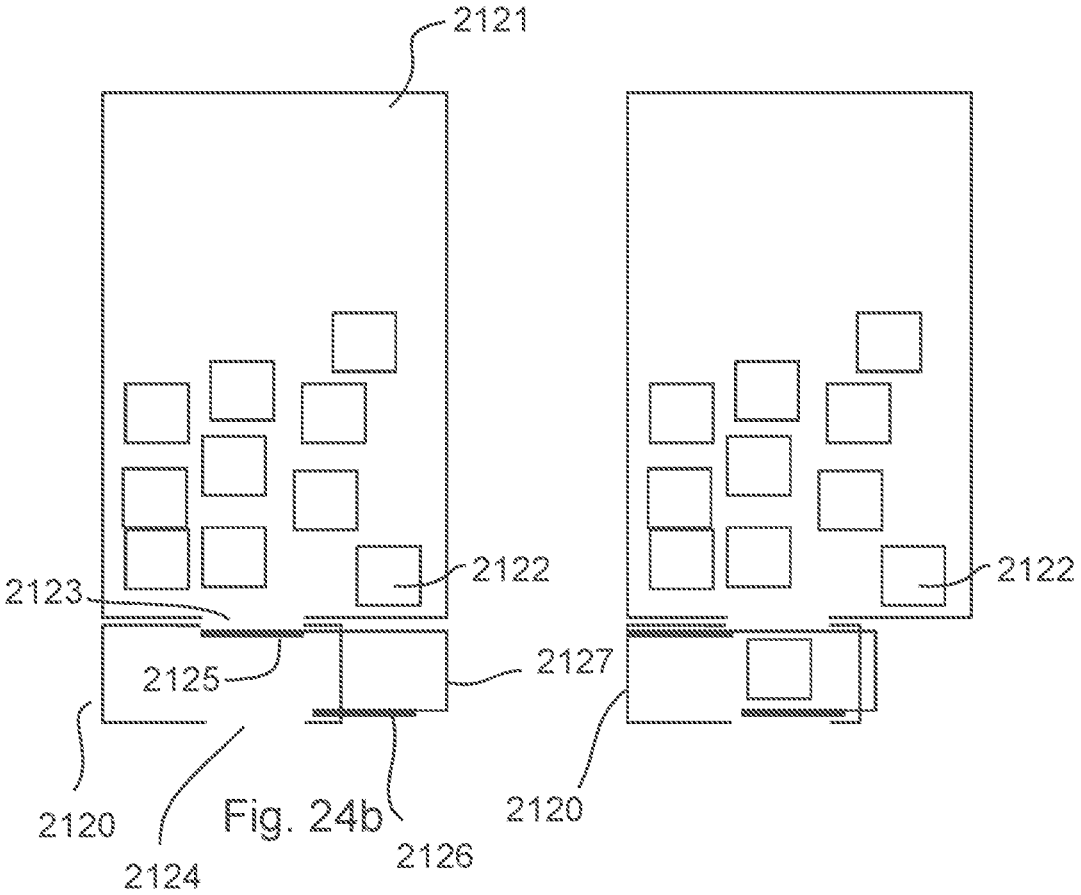
FIG. 24*b* shows two schematic cross section views of a fifth embodiment of an ice cube dispensing unit according to the second invention in a closed and open position.

FIG. 24*c* also shows an example of a plug 3120 which completely fills a filling opening 3121 in a sidewall 3122 of an ice cube tray. In this case, the plug is a sphere. The filling opening is also formed to fit the sphere. Instead of a complete sphere, a plug with a rounded inner surface could also be used.

In the embodiments of FIGS. 23*c* and 24*c*, it would be beneficial to form the inner most surface of the plugs with a flexible material, for example rubber. In this way, the surface of the plug would deform against the innermost edge of the filling opening, thereby increasing the sealing effect of the plug.

Figure 25D:
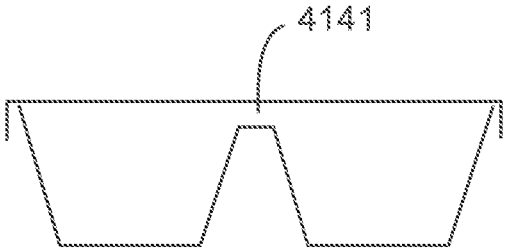
Figure 25E:
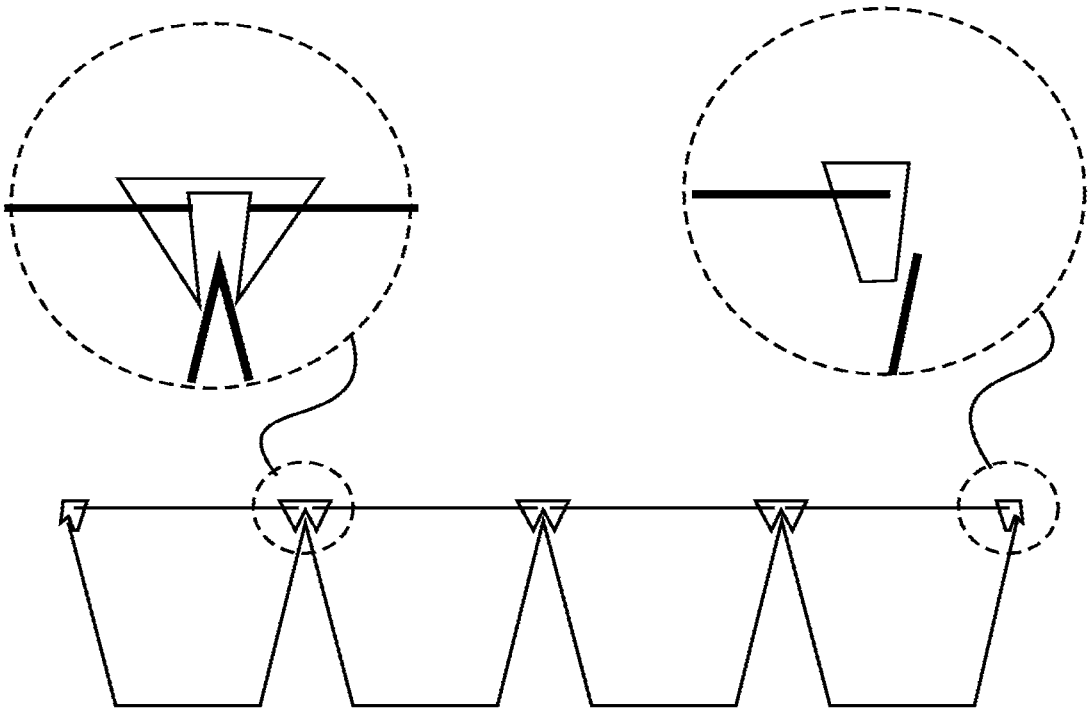
FIG. 25*e* schematically shows another embodiment of a sealed ice cube tray unit according to the fifth invention.
Figure 25C:
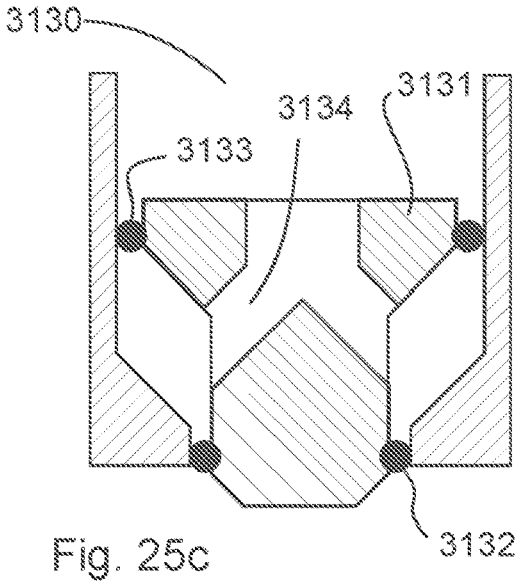
FIGS. 25*c* and 26*c* shows another embodiment of a filling opening and a plug in two different positions.
Figure 26C:
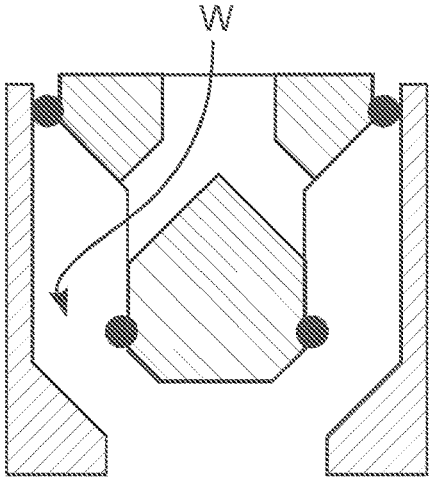

FIGS. 25*c* and 26*c* show another embodiment of a filling opening 3130 and a plug 3131. The filling opening in this case is formed as an elongated channel. The plug is formed with a first sealing surface 3132 and a second sealing surface 3133. A channel 3134 is provided in the plug between the first and second sealing surfaces. In the first position shown in FIG. 25*c*, the first and second sealing surfaces seal against the inside surfaces of the elongated channel. However, in FIG. 26*c*, the plug has been slightly displaced in the filling opening. In this case, the second sealing surface is still in contact with the inside surface of the elongated channel, but the first sealing surface is no longer in contact with the inside surface of the elongated channel. Due to this, water can be poured into the channel 3134 in the plug which flows through the plug. Where the second sealing surface not in place, then water poured into the channel in the plug could run up over the sides of the elongated channel and run into the inside of the unit.

Figure 27C:
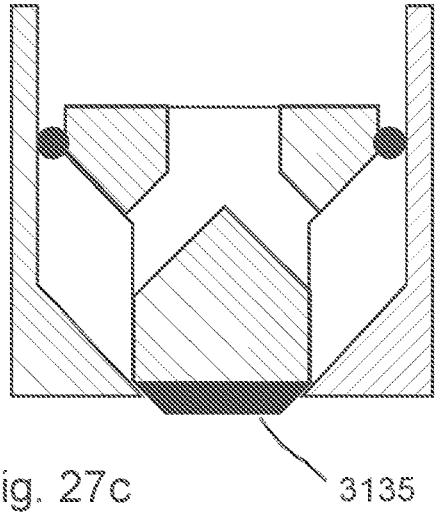
FIGS. 27*c* and 28*c* shows another embodiment of a filling opening and a plug.

FIG. 27*c* shows another version of the plug of FIGS. 24*c* and 26*c* where the inner portion 3135 of the plug is made from a flexible material, for example rubber. The inner portion of the plug therefore deforms when it is pressed up against the filling opening thereby ensuring a proper seal.

Figure 28C:
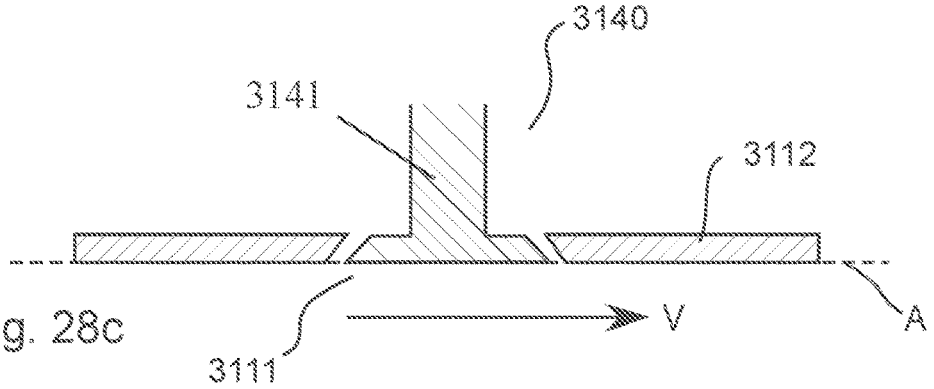

FIG. 28*c* shows another embodiment of a filling opening 3140 and plug 3141. In the previous embodiments, the plug has been pushed into the filling opening from the outside of the ice cube compartment. In the embodiment of FIG. 28*c*, the opposite is true. When it is desired to open the filling opening, the plug 3141 is pushed into the ice cube compartment. When it is desired to close the opening, the plug is pulled into the opening. In this case it is important that the plug does not protrude into the ice cube tray so that the plug interferes with removal of the ice cube from the tray.'

Fourth Invention

Figure 21D:
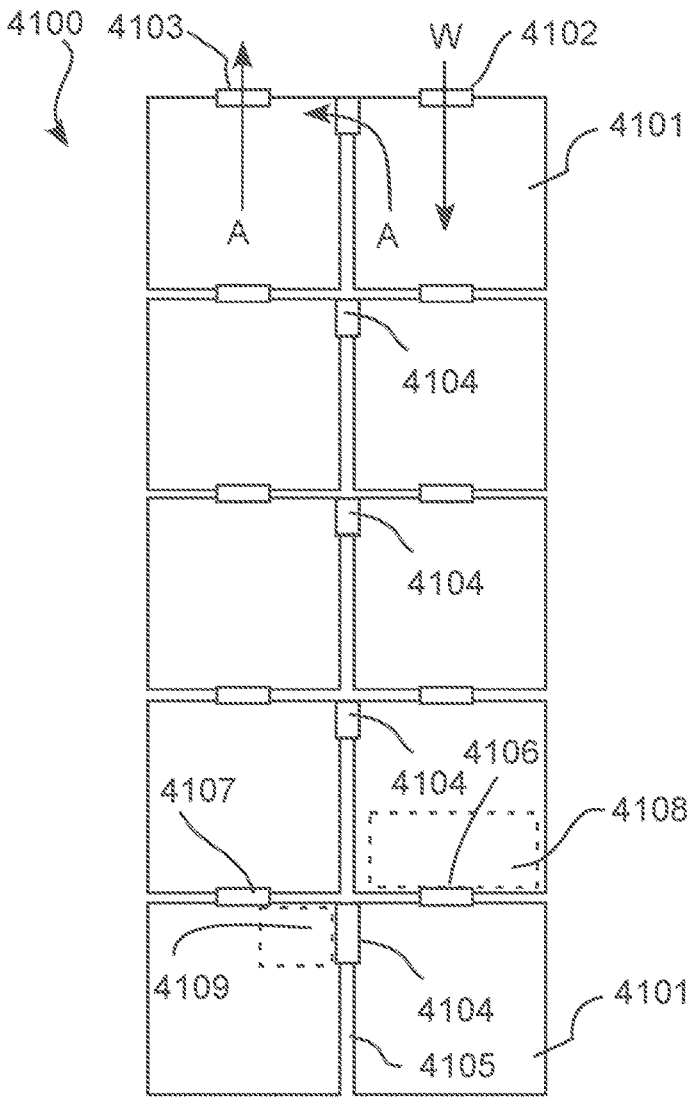
FIG. 21*d* schematically shows another embodiment of a sealed ice cube tray unit according to the fourth invention.

FIG. 21*d* shows a sealed ice cube tray unit 4100 according to the current invention in a very schematic way. The unit is comprised of ten individually sealed ice cube compartments 4101. The ice cube compartments are arranged in a grid structure being two ice cube compartments wide and five deep. Other arrangements could also be possible. A water filling opening 4102 is arranged in association with the top right ice cube compartment and an air vent 4103 is associated with the top left ice cube compartment. As can be seen from the figure, the tray unit is filled in an upright or vertical orientation. This is opposite to the prior art trays which are filled in a horizontal position. Filling in a vertical position has a big advantage since it is easier to hold an elongated element in a vertical position than it is to hold an elongated element in a horizontal position. Small misalignments in the horizontal position will have large effects on how the water is distributed in the tray. However, small misalignments in the vertical position will have a small effect on how the water is distributed in the tray.

In the current embodiment, it can be said that the central axis of the filling opening has a component which is parallel with the longitudinal axis of the tray.

In general, it can be seen from the figure that the water and the air flow in the unit have been separated into two separate flow paths. In general, the water runs down the right most column of ice cube compartments until the bottom right compartment is filled. Then the water flows over into the left most column via the opening 4104 in the divider 4105 between the left and right ice cube compartments. It can also be seen that while the lower right ice cube compartment is being filled with water through the water opening 4106, air already present in the ice cube compartment can easily escape the compartment via the opening 4104.

Once the left bottom ice cube compartment is completely filled, the ice cube compartments will slowly fill from the bottom. Air in the rightmost column will always be able to get over into the left most column via the openings 4104. Air in the left most column will always be able to exit the top of the ice cube compartment via the openings 4107 at the top of the ice cube compartment.

It can also be seen that the opening 4104 in the divider between right and left ice cube compartments is arranged at the top of the ice cube compartments. In this way, it is first when the ice cube compartment is completely filled that no more air can escape through this opening. In general, it can be said that the top of the opening 4104 for air is located at the same level as the bottom of the opening 4106 for water. In this way, air can get out of the compartment until the compartment is completely filled. If the top of the opening 4104 for air were located further below the bottom of the opening 4106 for water, then at some point, the opening 4104 for air would be completely blocked by water. This would force air to leave via the opening 4106 in the top of the compartment or out though the side opening 4104 even though it was filled with water. This would slow down the filling process.

It can also be said that in the case of the right bottom ice cube compartment, that the ice cube compartment located above it is a first volume 4108 connected to the ice cube compartment via the first opening 4106 and that the left ice cube compartment is a second volume 4109 connected to the ice cube compartment via the second opening 4104. It can also be seen that air can escape through the second opening 4104 until the ice cube compartment is completely filled with water.

It can also be seen that in general, unless too much water is poured in through the water filling opening 4102, then the water and air flow will always follow the same path. The water will always fill an ice cube compartment via a first opening and air will always leave the ice cube component via a second opening. It is true that at the very end of the filling process of an ice cube compartment, a small amount of water is also poured out through the second opening. In the case of the air vent opening 4103, this can be used as a signal that the tray is full.

It should also be mentioned that it is possible to dimension the openings so that it is possible to more precisely control the water flow. For example, by forming the water filling opening as shown in FIGS. 1-20, the water flow into the filling opening is disrupted and it is prevented that water enters the chambers with a very high flow and/or pressure. Then by balancing the openings 4106 in the bottom of the ice cube compartments, the flow through the system can be controlled. For example, if the openings 4106 at the bottom of an ice cube compartment are smaller than the openings at the top of the ice cube compartment, then flow will start to back up in the system. But by balancing the sizes of the openings, the flow can be controlled.

Additional openings could also be provided to provide for even more water flow. For example an opening (not shown) at the bottom of the divider between left and right ice cube compartments could be provided.

Figure 22D:
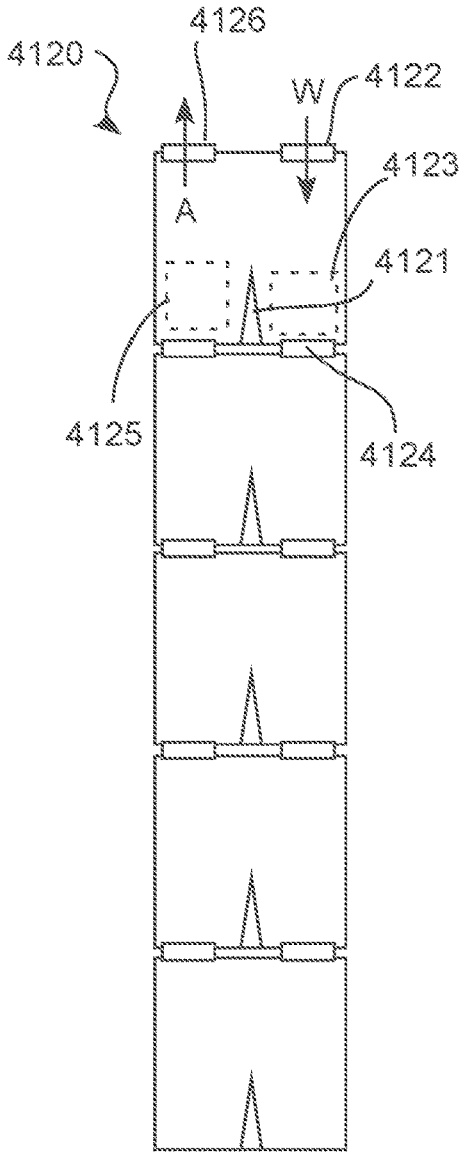
FIG. 22*d* schematically shows another embodiment of a sealed ice cube tray unit according to the fourth invention.

FIG. 22*d* shows another embodiment 4120. In this embodiment, instead of having two columns of ice cubes, only one column of ice cube compartments is provided. This is similar to the arrangement shown in the embodiment shown in FIGS. 1-20. In the embodiment of FIGS. 1-20, angled dividers were used such that the first opening was arranged underneath the second opening. In this way, a volume of water could be arranged above the first opening while the second opening was still free. This can also be said to be a manner of separating the air and water flows. In the embodiment of FIG. 22*d*, instead of arranging the first opening below the second opening, a small partial divider 4121 has been introduced between the first and second openings. In this way, water poured into the water filling opening 4122 will be stored in the volume 4123 to the right of the divider and above the first opening 4124. However, the volume 4125 to the left of the divider will remain free of water and air can exit the lower ice cube compartment through the second opening without having to pass through a volume of water.

As with the previous embodiment, a water filling opening and a separate air vent 4126 is provided in the upper most ice cube compartment. However, depending on how the water filling opening is arranged, it might not be necessary to have a separate air vent opening. As long as air can escape through the water filling opening while filling the tray with water through the water filling opening, then it should still be possible to have the benefits of the current invention. This is shown in FIG. 23*d*. Of course, if the user pours water into the opening such that half the water ends up on the left side of the divider and half of the water ends up on the right side of the divider, then the advantages will not be present, but if the user pours the water correctly, then it will be easy to fill the unit.

It should be noted that with the embodiments of FIGS. 21*d*-23*d*, the description has said that the openings are provided in the dividers between adjacent ice cube compartments. However, the dividers could be completely formed by the ice cube tray, or the dividers could be formed by a combination of a part of the ice cube tray and a part of the lid. For example, flanges could be arranged on the lid which extend down from the lid to engage with the upper edges of the ice cube compartments. In this case, the openings could be provided in a portion of the lid, i.e. in the flanges of the lid.

Figure 24D:
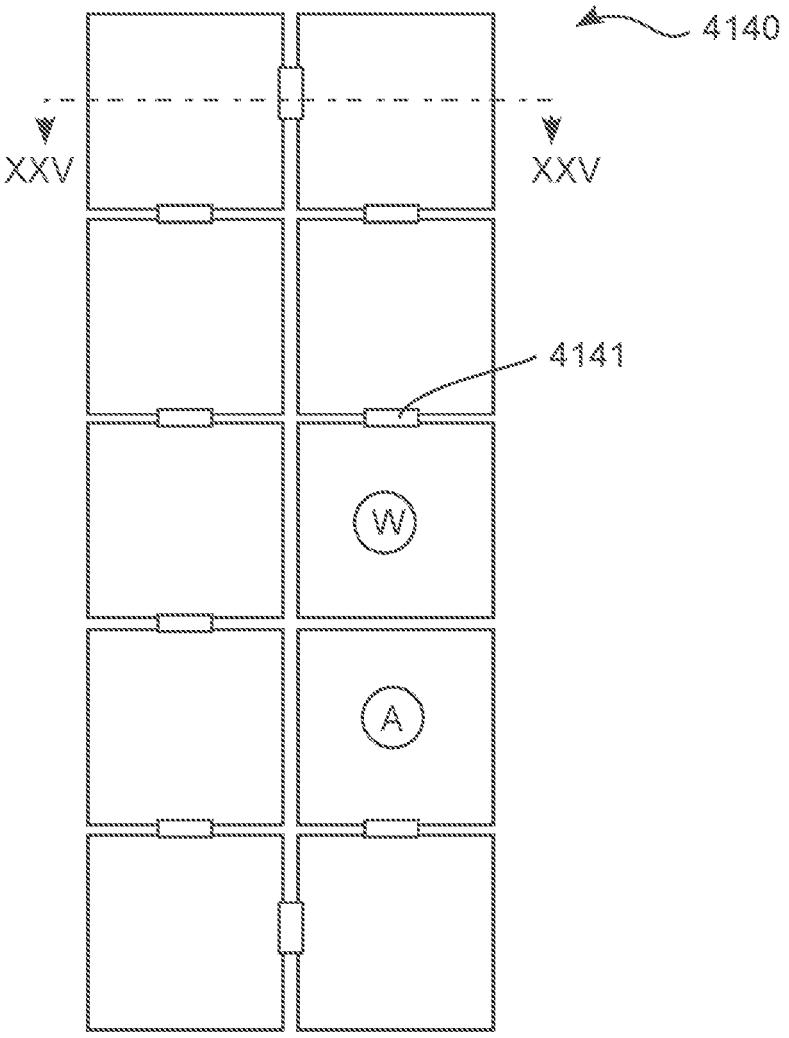
FIGS. 24*d* and 25*d* schematically show two views of another embodiment of a sealed ice cube tray unit according to the fourth invention.

FIGS. 24*d* and 25*d* show another embodiment 4140 of a sealed ice cube tray unit according to the current invention. In this case, the unit is of the kind which is arranged horizontally during filling. Water is poured into the opening W and air is vented through the opening A. As can be seen there is only one path for the water to flow through the ice cube tray. Water will flow from the ice cube compartment with the filling opening up and then counterclockwise around the ice cube tray until it reaches the ice cube compartment with the air vent A. Small channels 4141 are provided between the dividers between adjacent ice cube compartments. However, the channels are not provided in all dividers, since that would lead to uncontrolled fluid flow and there could be a risk that a compartment could still be filled with air while all the adjacent compartments were already filled completely with water.

Figure 26D:
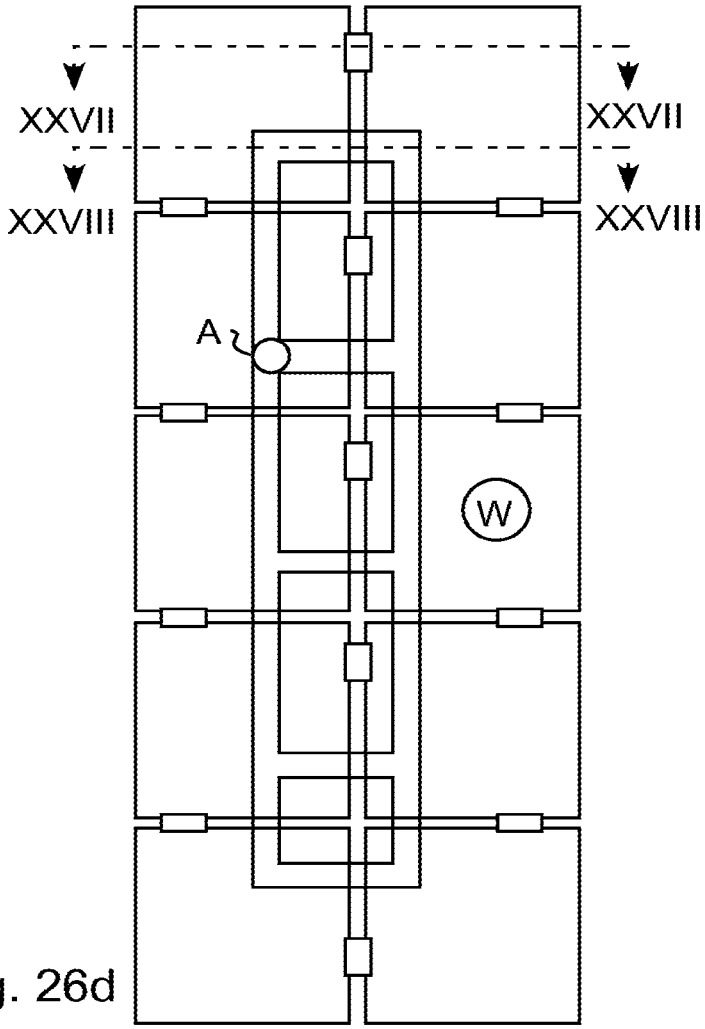
Figure 27D:
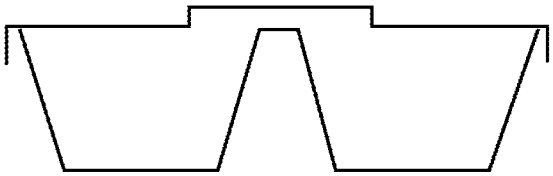
Figure 28D:
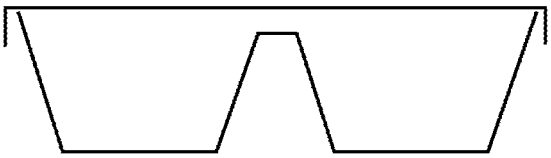

FIG. 26*d* shows another example of a horizontal ice cube tray unit. In this case, water channels in the tray portion are provided in all the dividers to allow water to flow between adjacent ice cube compartments. Furthermore, an air channel and an air vent have been arranged in the lid of the ice cube tray unit. Since the air channel is arranged above the water channels with respect to the vector of the central axis of the filling opening, the air will be able to exit the ice cube compartments all the time as long as the tray is held completely horizontally.

In the above description of FIGS. 21*d*-28*d*, the water filling openings and the air vents have always been shown open. However, it is clear that the tray could further comprise a plug for sealing the water filling opening and/or a plug for sealing the air vent.

Fifth Invention

Figure 21E:
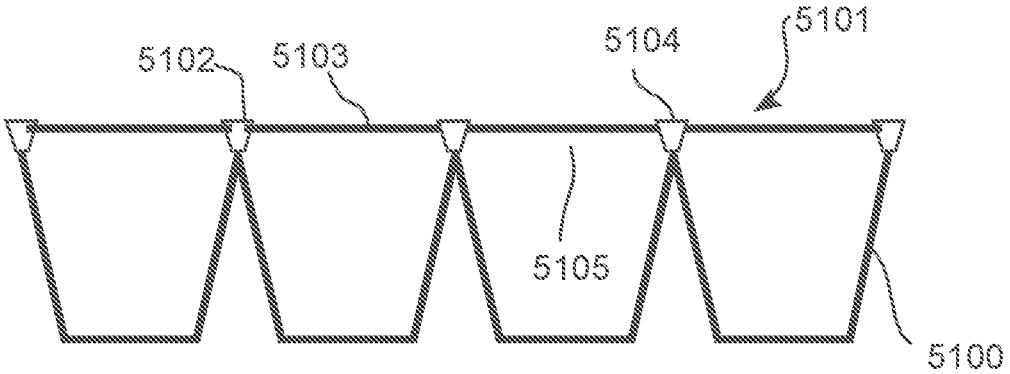
FIG. 21*e* schematically shows another embodiment of a sealed ice cube tray unit according to the fifth invention.

The embodiment of FIG. 21*e* shows an ice cube tray 5100 and a lid 5101. The lid comprises a frame portion 5102 and flexible sheet elements 5103. The frame portion is arranged as a grid structure with ribs 5104 which are formed to match the shape of the upper edges of the ice cube tray. The frame portion is also provided with hollow sections 5105. In each hollow section, a flexible sheet 5103 is arranged. As the ice cube expands in the ice cube compartment, the ice will press against the flexible sheet and be allowed to expand. The flexible sheet element and the frame portion are so designed that as the ice expands, the flexible sheet element will absorb the expansion without the frame portion deforming significantly.

It should also be noted that in the previous embodiment, the flexible sheet element was arranged between the frame portion and the tray. However in this embodiment, the flexible sheet element is arranged purely in the frame portion. It is therefore the frame portion which is in contact with the upper edges of the tray and not the flexible sheet element. Furthermore, it can be seen that the flexible sheet element is arranged a distance away from the upper edge of the ice cube tray. Depending on how the ice cube tray is filled, it could be possible to fill water into the tray so that it extends past the upper edge of the tray.

Figure 22E:
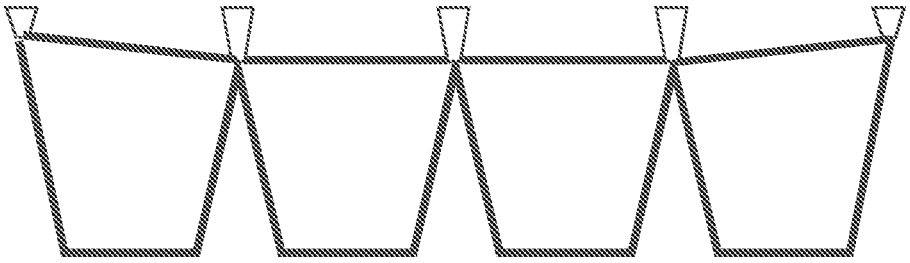
FIG. 22*e* schematically shows another embodiment of a sealed ice cube tray unit according to the fifth invention.

FIG. 22*e* shows another embodiment of an ice cube tray unit according to the current invention. The concept is very similar to the embodiments of FIG. 12 and FIG. 21*e*, and as such won't be described in detail here. However, as can be seen from the figure, the upper edges of the tray are not all arranged in a single plane.

FIG. 23*e* shows another embodiment of an ice cube tray unit according to the current invention. The unit comprises an ice cube tray 5120 having four ice cube compartments 5121 and a lid 5122. The lid comprises a frame portion 5123 and four expansion absorbing portions 5124 each being associated with one of the four ice cube compartments. In the current embodiment, the expansion absorbing portions are formed from a compressible material, for example foam, which compresses as the ice expands. Once the ice is removed from the ice cube tray unit, the material expands again.

Figure 24E:
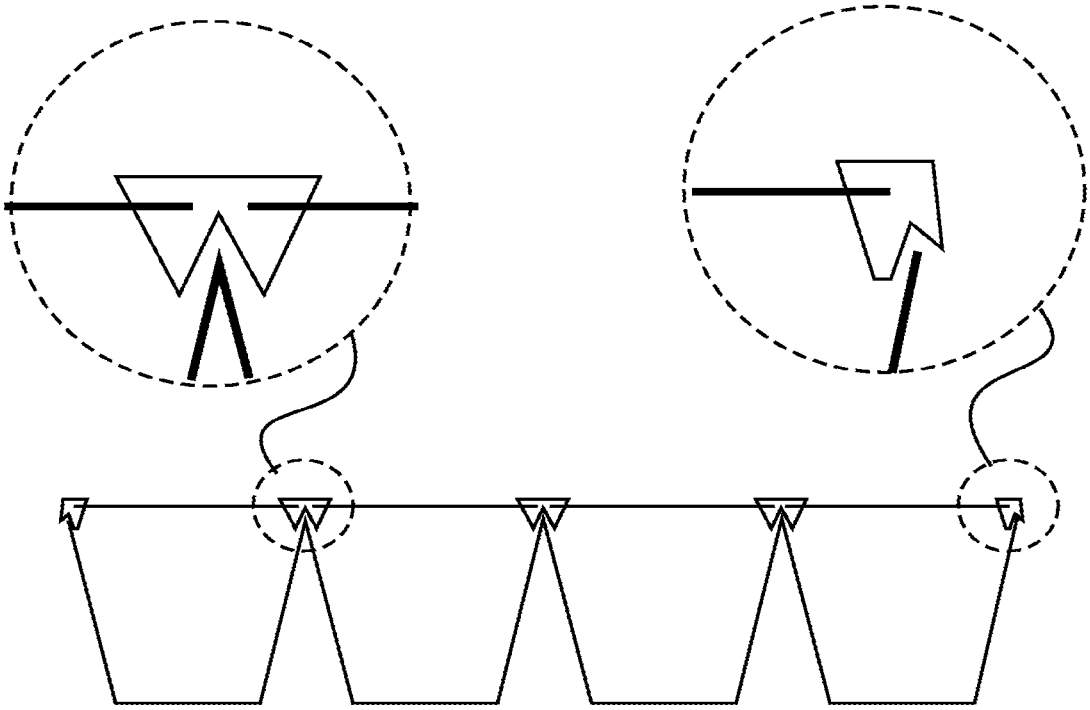
FIG. 24*e* schematically shows another embodiment of a sealed ice cube tray unit according to the fifth invention.

FIG. 24*e* shows another embodiment of an ice cube tray unit according to the invention. This embodiment is very similar to the embodiment of FIG. 21*e*, however instead of providing a lid which only applies pressure directly to the upper edges of the ice cube compartments, in the current embodiment, pressure is also applied to the inner sides of the ice cube compartments around the upper edges of the ice cube compartments via the sealing elements. In this way, an even better seal is formed. Furthermore, should the frame portion deform slightly and be lifted slightly up and away from the tray, the seal would still be maintained due to the sealing elements which protrude into the ice cube compartments. FIG. 25*e* is an even more demonstrative example of this idea. In this embodiment, no pressure is applied to the upper edge of the ice cube tray at all. The sealing elements are just pushed into the ice cube compartments where the wedge into place against the inside surface of the ice cube compartments near the upper edge of the ice cube compartment.

It is to be noted that the figures and the above description have shown the example embodiments in a simple and schematic manner. Many specific mechanical details have not been shown/described in detail since the person skilled in the art should be familiar with these details and they would just unnecessarily complicate this description. For example, the different processes used to manufacture the components have not been discussed here since the person skilled in the art will be able to provide suitable processes. Furthermore, specific materials used have not been described in details, since many different types of suitable materials will be known to the person skilled in the art. Also, additional details are shown in the figures which are clear to the person skilled in the art. Many of these features have not been described in detail in the specification, but these details also form a part of the disclosure of this application. Furthermore, in the above specification, most often water is used as the liquid which is frozen. However, the person skilled in the art should understand that other liquids besides water could also be used in the unit.

The invention claimed is:

1. A sealed ice cube tray unit comprising an ice cube tray and a lid, said ice cube tray comprising two adjacent ice cube compartments, where each of said two ice cube compartments has a bottom and a sidewall, the sidewall being arranged such that the upper edge of the sidewall defines an opening through which an ice cube formed in the compartment can be removed and where said lid is mounted on said ice cube tray in order to individually seal water or other liquid inside said ice cube compartments, characterized in that said lid comprises a frame portion and two individual expansion absorbing portions, said frame portion being arranged to apply pressure to the ice cube compartments near the upper edges of the ice cube compartments to establish a seal between the ice cube compartments and the lid and said expansion absorbing portions each being associated with one of said two ice cube compartments such that when water contained in the ice cube compartment freezes and expands, the expansion absorbing portion associated with the ice cube compartment will deform more than the frame portion of the lid.

2. The sealed ice cube tray unit of claim 1, wherein each of said two expansion absorbing portions comprises a flexible sheet element arranged to cover at least a portion of the ice cube compartment.

3. The sealed ice cube tray unit of claim 2, wherein said flexible sheet element is arranged between the upper edge of the ice cube tray and the frame portion and that said frame portion presses the flexible sheet element against the upper edge of the ice cube compartment.

4. The sealed ice cube tray unit of claim 2, wherein said flexible sheet element of each of said two expansion absorbing portions are of a single flexible sheet element which covers at least a portion of both of said two ice cube compartments.

5. The sealed ice cube tray unit of claim 1, wherein said frame portion is provided with hollow portions which are associated with the expansion absorbing portions such that frame portion provides room for the expansion absorbing portions to deform.

6. The sealed ice cube tray unit of claim 1, wherein said frame portion comprises a lower edge which is complementary in shape to the upper edge of the ice cube compartments.

7. The sealed ice cube tray unit of claim 1, wherein said upper edges of said ice cube compartments are arranged in a single plane.

8. The sealed ice cube tray unit of claim 1, wherein said lid is provided with sealing elements which extend past the upper edge of the ice cube compartments and at least partly into the ice cube compartments.

9. The sealed ice cube tray unit of claim 1, wherein said lid comprises a sealing element for each ice cube compartment and that each sealing element is formed to fit the upper edge of its respective ice cube compartment.

10. The sealed ice cube tray unit according to claim 1, wherein said expansion absorbing portions are made of a compressible element.

11. The sealed ice cube tray unit according to claim 10, wherein the compressible element is a compressible foam material.

* * * * *